US007401587B2

(12) United States Patent
Thomas et al.

(10) Patent No.: US 7,401,587 B2
(45) Date of Patent: Jul. 22, 2008

(54) GAS AND OIL SEALING IN A ROTARY VALVE

(75) Inventors: Andrew Donald Thomas, North Epping (AU); Anthony Bruce Wallis, Gladesville (AU)

(73) Assignee: Bishop Innovation Limited, New South Wales (AU)

( * ) Notice: Subject to any disclaimer, the term of this patent is extended or adjusted under 35 U.S.C. 154(b) by 0 days.

(21) Appl. No.: 11/659,724

(22) PCT Filed: Aug. 31, 2005

(86) PCT No.: PCT/AU2005/001306

§ 371 (c)(1),
(2), (4) Date: Feb. 8, 2007

(87) PCT Pub. No.: WO2006/024081

PCT Pub. Date: Mar. 9, 2006

(65) Prior Publication Data

US 2007/0251485 A1 Nov. 1, 2007

(30) Foreign Application Priority Data

Sep. 1, 2004 (AU) ..... 2004904980

(51) Int. Cl.
*F01L 7/16* (2006.01)

(52) U.S. Cl. ..... 123/190.17; 123/80 BA

(58) Field of Classification Search ..... 123/80 R, 123/80 BA, 190.8, 190.17, 190.1
See application file for complete search history.

(56) References Cited

U.S. PATENT DOCUMENTS

| | | | | | |
|---|---|---|---|---|---|
| 4,019,487 | A | | 4/1977 | Guenther | |
| 4,036,184 | A | | 7/1977 | Guenther | |
| 4,444,161 | A | | 4/1984 | Williams | |
| 4,852,532 | A | | 8/1989 | Bishop | |
| 5,074,265 | A | * | 12/1991 | Ristin et al. | 123/292 |
| 5,509,386 | A | | 4/1996 | Wallis et al. | |
| 5,526,780 | A | | 6/1996 | Wallis | |
| 5,941,206 | A | * | 8/1999 | Smith et al. | 123/190.4 |
| 6,138,628 | A | * | 10/2000 | Alex et al. | 123/190.1 |
| 6,237,556 | B1 | * | 5/2001 | Smith et al. | 123/190.8 |
| 6,651,605 | B2 | * | 11/2003 | Trentham | 123/190.8 |
| 2006/0185640 | A1 | * | 8/2006 | Barnes | 123/190.8 |
| 2007/0266985 | A1 | * | 11/2007 | Wallis | 123/190.17 |

* cited by examiner

*Primary Examiner*—Hai H Huynh
(74) *Attorney, Agent, or Firm*—Birch, Stewart, Kolasch & Birch, LLP

(57) ABSTRACT

A sealing system for an axial flow rotary valve internal combustion engine comprising an array of floating gas seals and an optional oil sealing system. The array of floating seals surrounding a window (15) in the bore (11) of the cylinder head (10) through which the ports (2, 3) of the valve (1) communicate with a combustion chamber (31). The array of floating seals comprising axial seals (16) and circumferential seals (17) housed in slots (18, 19) in the bore of the cylinder head wherein the circumferential seals are disposed axially between the ends of the axial seals.

22 Claims, 19 Drawing Sheets

GAS AND OIL SEALING IN A ROTARY VALVE

TECHNICAL FIELD

The present invention relates to gas and oil sealing arrangements for rotary valve internal combustion engines, and in particular to axial flow rotary valves that accommodate one or more ports in the valve terminating as openings in the valve's periphery.

BACKGROUND

The present invention is particularly concerned with axial flow rotary valve arrangements that have long windows (i.e. window lengths, as measured in the axial direction, greater than 50% of the cylinder bore diameter), in order to maximise the breathing capacity of the internal combustion engine to which the rotary valve assembly is fitted. Maximum breathing capacity is a dominant consideration in modern engines, where manufacturers seek to gain the greatest power output from the smallest engine size for fuel consumption and emissions reasons.

During rotation of an axial flow rotary valve, openings in the periphery of the valve are arranged to periodically communicate with a similar window in the cylinder head that opens directly into the combustion chamber. Alignment between the opening and the window allows the passage of gas from the valve to the combustion chamber or vice versa. During the compression and power strokes the periphery of the valve blocks the window in the combustion chamber. The valve is typically supported by bearings located either side of a centrally located cylindrical portion of the valve in which the opening (or openings) in the valve's periphery is located. The valve and its bearings are housed in a bore in the cylinder head in such a fashion as to ensure the cylindrical portion can rotate whilst always maintaining a small radial clearance to the bore.

Large numbers of rotary valve arrangements have been proposed but none have achieved commercial success. One of the major contributing factors to this lack of success is the failure to design a satisfactory gas and oil sealing arrangement.

U.S. Pat. No. 4,036,184 (Guenther) and U.S. Pat. No. 4,852,532 (Bishop) disclose rotary valve arrangements which rotate with a small predetermined clearance to the cylinder head bore in which the rotary valve is housed and gas sealing arrangements using arrays of floating seals. A system of four or more separate sealing elements forms a floating seal grid around the window. The sealing elements are loaded against the periphery of the cylindrical portion of the valve. The cylindrical portion typically extends a small distance past the axial extremities of the array of floating seals.

The function of such an array of floating seals is to trap the high pressure gases within the rectangle formed by the outer surfaces of these seals. The effectiveness of this sealing system depends on its ability to seal the zone at the point of intersection of the individual sealing elements. As the abutting seals must be free to move independently of each other (to accommodate thermal expansion and manufacturing tolerances), there will always be a small gap at each intersection point. As there are at least four such intersection points per assembly, the total leakage gap has the potential to be large. U.S. Pat. No. 5,526,780 (Wallis) introduced the concept of "total effective leakage area" (TELA) as a means of quantifying the leakage area of a particular sealing arrangement.

Both the sealing systems disclosed in U.S. Pat. No. 4,036,184 (Guenther) and U.S. Pat. No. 4,852,532 (Bishop) do not work satisfactorily due to excessive leakage from the seal pack. So great is this leakage that it is unlikely that the engines using these arrangements will be able to be started using conventional starter motors. Leakage from the operating engine will be so great that the efficiency will be unacceptably low and the exhaust emissions unacceptably high.

The arrangements shown in both U.S. Pat. No. 4,036,184 (Guenther) and U.S. Pat. No. 4,852,532 (Bishop) seal the high pressure gases in a similar manner and the cause of this excessive leakage is the same for both arrangements. During compression and combustion the high pressure gases in the cylinder push the circumferential seals away from the end of the axial seals leaving an "L" shaped clearance cavity through which the high pressure gases can escape. The side of the "L" shaped clearance is formed between the axially innermost surface of the circumferential seal (end seal in the terminology of U.S. Pat. No. 4,036,184) and the axially innermost surface of its slot (notch in the terminology of U.S. Pat. No. 4,036,184). The bottom of the "L" shaped clearance is formed between the bottom of the circumferential seal and the bottom of its slot.

High pressure combustion gases fill the "L" shaped clearance volume and travel transverse to the axial direction towards both ends of the circumferential seal. Gas trapped in the portion of the "L" shaped clearance volume located circumferentially outside the axial seals (side seals in the terminology of U.S. Pat. No. 4,036,184) can discharge into the clearance, which is at or near atmospheric pressure, between the periphery of the valve and the bore in which the valve is housed. In both U.S. Pat. No. 4,036,184 (Guenther) and U.S. Pat. No. 4,852,532 (Bishop) this gas is discharged from between the axially innermost face of the circumferential seal and the axially innermost face of the slot in which the circumferential seal is housed. In the case of U.S. Pat. No. 4,036,184 (Guenther), the gas is additionally discharged between the ends of the circumferential seal and the adjacent end walls of the slot. As there are four corners from which this discharge can take place, the total leakage area is very large. In the absence of specific measures, of which none are disclosed, to control the discharge from the portion of the circumferential seals located outside the axial seals, leakage will be unacceptably high for any modern engine.

These sealing problems were identified and addressed in U.S. Pat. No. 5,526,780 (Wallis). It disclosed a sealing arrangement where the TELA was in the order of one thirtieth (1/30) that of the arrangement found in U.S. Pat. No. 4,852,532 (Bishop). The typical TELA of the seal arrangement in U.S. Pat. No. 5,526,780 (Wallis) was 0.02 $mm^2$ which is less than the leakage area of a conventional piston ring.

Although the arrangement disclosed in U.S. Pat. No. 5,526,780 (Wallis) satisfactorily addressed the gas leakage issues it required two additional sealing elements and was found to have other problems. In particular this arrangement is particularly difficult to assemble and has excessive crevice volume, particularly when measured relative to the combustion chamber volume on engines with small cylinder capacity. The mounting of the ring seals in the periphery of the valve means the valve has to be larger in diameter than would have otherwise been required. In addition the ring seals at either end of the openings in the valve periphery have large sealing areas between the sealing rings and the valve. These sealing areas are subject to full combustion pressure. Consequently friction drive losses are high. Finally, the seal arrangement is very difficult to assemble as the inner partial ring seals have to be aligned during assembly such that the inner ends of these inner partial ring seals sit outside the small lugs at either end of the axial seals. As the required clearance between the lugs and the inner end of these inner partial ring seals is small, correct alignment during assembly is very difficult and not conducive to high volume production.

Although the crevice volume issues relating to the arrangement disclosed in U.S. Pat. No. 5,526,780 (Wallis) were extensively considered, it was subsequently found that in engines with small cylinder capacity the crevice volume was still sufficiently large to adversely affect the engines performance. The fuel/air mixture in these crevice volumes cannot be burned during the normal combustion process and this consequently results in poor engine fuel economy and performance, and high exhaust emissions. Crevice volumes remote from the spark plug are particularly detrimental, as the expanding flame front pushes unburnt gases into these crevice volumes and the rapidly increasing cylinder pressure means the density of the unburnt gases in the crevice volume rises rapidly. Consequently the mass fraction of the unburnt gases trapped in the crevice volume is much greater than the volume fraction of the crevices.

A feature of sealing arrangements of the type disclosed in the present invention and in U.S. Pat. No. 5,526,780 (Wallis) is the use of the high pressure cylinder gas to actuate the sealing elements. Hence, the greater the pressure required to be sealed, the greater is the closing force applied between the seal and the valve and between the seal and its sealing face in its respective slot. This can only be achieved by allowing the high pressure gas to migrate into those areas surrounding the sealing elements in their slots. The volume occupied by this gas is crevice volume since the air/fuel mixture cannot be burned in these areas during the normal combustion process.

The excessive crevice volume in U.S. Pat. No. 5,526,780 (Wallis) is the result of two issues. Firstly, the outer ring seals extend around the entire periphery of the valve and the inner ring seals extend around approximately 75% of the periphery of the valve. As a result, there is a large crevice volume formed between these seals and the mating groove in the valve and between the ring seals themselves. This problem was exacerbated by the fact that this crevice volume was located a large distance from the spark plug, and consequently the density of the mixture filling this area was high and consisted mainly of unburnt gases. Secondly, the ring seals were located at the end of the axial seals leaving a long cavity between the axial extremity of the window and the ring seals. These two issues resulted in unacceptably large crevice volumes with resulting poor performance and high emissions.

Thus in the prior art there are at least three gas sealing arrangements proposed to seal a rotary valve of the type that operates with clearance between the rotary valve and the bore in which it is housed. Two of these solutions U.S. Pat. No. 4,036,184 (Guenther) and U.S. Pat. No. 4,852,532 (Bishop) do not seal adequately. The third solution U.S. Pat. No. 5,526,780 (Wallis) addresses the sealing issue but introduces other problems.

A successful gas sealing system should preferably satisfy six criteria. Firstly, it should seal high pressure combustion gas with a minimum of leakage. This leakage is referred to as "blow-by". Blow-by contains unburned hydrocarbons that are tightly regulated by emissions legislation around the world. Secondly, a successful gas sealing system should have minimal crevice volume. Thirdly, the arrangement must be capable of preventing the blow-by gases being discharged into the exhaust port where they appear as HC (hydro carbon) exhaust emissions. Fourthly, the gas sealing elements should produce minimal drag on the rotary valve in order to minimise frictional losses of the engine. Fifthly, the assembly should be capable of easy assembly in a mass production environment. Finally, the assembly should be capable of economic manufacture in a mass production environment. None of the prior arrangements provide solutions to all these criteria.

The present invention utilizes an array of axial seals and circumferential seals surrounding a window in the cylinder head. The closest prior art to this arrangement is found in U.S. Pat. No. 4,036,184 (Guenther) and U.S. Pat. No. 4,852,532 (Bishop). Both suffer from excessive leakage from the seal pack as previously described. U.S. Pat. No. 4,036,184 (Guenther) relates to a stratified charge radial flow rotary valve engine and describes an array of four sealing elements surrounding a window. U.S. Pat. No. 4,852,532 (Bishop) relates to an axial flow rotary valve engine and describes an array of four sealing elements surrounding a window.

Radial flow rotary valves of the type described in U.S. Pat. No. 4,036,184 (Guenther) with a single rotary valve per cylinder require the inlet and exhaust opening in the valve's periphery to be axially offset to one another. This clearly limits the axial opening length of both the inlet and exhaust peripheral opening. This, combined with the fact that the valve rotates at one quarter (¼) of the engine speed, means the arrangement will necessarily have very limited breathing capacity.

The present invention is particularly directed at axial flow rotary valves which rotate at one half (½) of the engine speed. In these arrangements the openings in the valve periphery overlap axially and are offset circumferentially. Consequently the openings may be very long (typically greater than 80% of the cylinder bore diameter). These larger openings, combined with the fact that the valve rotates at half engine speed, means the breathing capacity of such an arrangement is far in excess than anything that may be obtained with a single radial flow valve per cylinder.

The ability to form long openings in the valve periphery introduces design constraints on axial flow rotary valves that are not present on arrangements employing a single radial flow rotary valve per cylinder. Unlike radial flow valves of the type described in U.S. Pat. No. 4,036,184 (Guenther), the only place an axial flow arrangement can support the axial seals is outboard of the axial extremities of the openings in the valve periphery. In arrangements employing a single radial flow valve per cylinder there is minimal requirement for axial seal support outside the axial extremities of the opening in the valve periphery, as there are "bridges" of complete valve diameter between adjacent openings to support the axial seal. Consequently in radial flow rotary valves of the type disclosed U.S. Pat. No. 4,036,184 (Guenther), the circumferential seals may be placed close to the adjacent window without adversely affecting the crevice volume.

In axial flow rotary valve arrangements of the type shown in U.S. Pat. No. 5,526,780 (Wallis) and U.S. Pat. No. 4,852,532 (Bishop) the axial seals spanning a single long opening must extend some distance axially past the end of the window, in order that they have sufficient bearing area on the periphery of the valve. Placing the circumferential seal axially outboard of the axial seal results in a large crevice volume between the axial extremities of the window and the circumferential seal. As this crevice volume is remote from the spark plugs, it will be filled predominately with unburned gases further exacerbating the problem caused by this crevice volume.

In U.S. Pat. No. 4,036,184 (Guenther) the axial seals are shown as being radially small and hence relatively flexible compared to the circumferential seals that are shown to be radially large and hence relatively stiff. The relative size and stiffness of these elements is presumably linked to the sealing function although there is no explanation in the patent. This is, however, an arrangement that cannot work.

The circumferential seal of the type depicted in U.S. Pat. No. 4,036,184 (Guenther) is unsatisfactory as it is too stiff to conform to the surface of the rotary valve. Thermal and mechanical loads distort the surface of the valve during operation. Even a statically perfectly matched seal will not seal against the valve's periphery during operation unless it is flexible enough to conform to the changing shape of the valve surface. This will inevitably result in leakage across the top of the seal and destabilisation of the sealing mechanism. The presence of high pressure gas between the valve and the mating surface of the circumferential seal will result in the seal being pushed away from the valve surface rather than being pushed into contact with the valve surface. The result will be massive leakage across the sealing surface of the circumferential seal.

The flexible axial seals are pressed against the periphery of the valve by means of a continuous wave spring. This spring arrangement would act to deflect the axial seals into the opening in the valve's periphery, hence potentially causing them to have a collision with the closing edge of the opening and destroying the seals. Axial seals must therefore have adequate stiffness and the spring arrangement appropriately designed to ensure this does not occur. In this prior art arrangement it is paradoxical that the circumferential seals (that must conform to the peripheral surface of the valve in order to seal) are radially deeper in section compared to the axial seals, which are required to be stiff.

In the case of an arrangement employing a single radial flow rotary valve per cylinder as described in U.S. Pat. No. 4,036,184 (Guenther) with three separate openings spaced axially along the rotary valve, each separated axially from one another, there is clearly less requirement for axial seal stiffness. However this arrangement would have very little breathing capability. U.S. Pat. No. 4,036,184 (Guenther) states that a twin valve arrangement is preferable because it allows central location of the pre-combustion chamber. A radial flow arrangement with two rotary valves per cylinder (ie. separate valves for inlet and exhaust) would in part address this breathing issue by allowing the use of long openings in the valve but would not work with the axial seal arrangement as depicted in U.S. Pat. No. 4,036,184 (Guenther). It is assumed that the twin valve arrangement would (although it is not shown) maximise the available opening (and window) length to improve breathing capability. This arrangement could only be made to work by substantially increasing the stiffness of the axial seals by increasing their depth. A twin valve arrangement would create additional crevice volume and leakage problems as there are now two seal arrays, which doubles both the TELA and crevice volume. In the absence of deep axial seals the wave spring will merely push the axial seal into the opening in the valve's periphery with resulting impact against the closing edge of the opening. A similar situation exits in axial flow rotary valve arrangements of the type shown in U.S. Pat. No. 5,526,780 (Wallis) and U.S. Pat. No. 4,852,532 (Bishop).

In any workable arrangement using long windows the radial depth and the stiffness of the axial sealing elements must be considerably greater than the radial depth and stiffness of the circumferential seals. Such an arrangement is disclosed in U.S. Pat. No. 4,852,532 (Bishop).

In addition to excessive stiffness problems the circumferential seals depicted in U.S. Pat. No. 4,036,184 (Guenther) have an additional problem. The large size of the seal means there will be an excessive crevice volume around the circumferential seal. In the case of U.S. Pat. No. 4,852,532 (Bishop), the long length of the circumferential seal results in excessive crevice volume around the seal despite the fact it is radially small.

Neither U.S. Pat. No. 4,036,184 (Guenther) nor U.S. Pat. No. 4,852,532 (Bishop) has a satisfactorily means of preventing the leakage from the seal pack entering the exhaust system and becoming an emissions problem. Today, the exhaust emissions from most engines are tightly regulated. In both U.S. Pat. No. 4,036,184 (Guenther) and U.S. Pat. No. 4,852,532 (Bishop) leakage past the sealing element will be delivered to the inlet and exhaust ports. Leakage circumferentially outboard of the trailing axial seal will end up in the inlet port (see FIG. 7 of U.S. Pat. No. 4,853,532) where it will be recycled harmlessly back into the engine. Leakage circumferentially outboard of the leading axial seal will end up in the exhaust port where it will be discharged from the exhaust as unburnt hydrocarbons. As leakage occurs from both ends of the circumferential seal outside the circumferential extremities of the axial seals approximately half of the total leakage will end up in the exhaust port and half in the inlet port. Such an engine will be unacceptable from an emissions perspective.

In the case of U.S. Pat. No. 4,036,184 (Guenther) the circumferential seals must be housed in blind ended slots (notches in the terminology of U.S. Pat. No. 4,036,184) in the cylinder head. There is no known mass production method of forming these blind ended slots. They could be manufactured by electro discharge machining but this is a slow process and the high depth of these slots would make the process even slower. In the case of U.S. Pat. No. 4,852,532 (Bishop) the circumferential seals are housed in circumferential slots that extend around the entire housing and are therefore easy to manufacture. However, this feature is the cause of the crevice volume problems.

Finally these prior art arrangements are difficult to assemble in a mass production situation. Each of the individual sealing elements has to be individually held in their retracted position whilst the rotary valve is assembled or the head assembly (including the fitted seals) is transported. In a multicylinder head assembly every seal will have to be fitted and retained individually before this subassembly is sent to have the valve assembled into the head.

In addition to requiring a gas sealing system, axial flow rotary valves usually also require an oil sealing system. The bearings supporting the rotary valve are typically lubricated with oil. In most instances the valve is also cooled with oil that is pumped through the valve. A successful oil sealing system must satisfy two criteria. Firstly, it must prevent the axial inward leakage of this oil into the central cylindrical portion of the valve and prevent the axial outward movement of blow-by gases into the oil system. Secondly, it must act in combination with the gas sealing elements to manage the passage of blow-by gases into an area where it can be disposed of without creating emissions. U.S. Pat. No. 4,036,184 (Guenther) is silent on this aspect.

U.S. Pat. No. 4,852,532 (Bishop) uses the circumferential seal as both a gas sealing and an oil sealing element. Such an arrangement has been demonstrated to not work as a satisfactory oil seal. During the induction stroke negative pressure in the cylinder pulls the circumferential sealing element axially inward against the axially inner wall of its seal slot. This opens up a gap between the axially outer face of the circumferential seal and the axially outermost wall of its seal slot. Oil driven by the oil pressure and the negative cylinder pressure can now enter this gap and deposit oil into the volume under the circumferential seal. During the compression stroke the circumferential seal is pushed axially outward against the axially outer wall of its seal slot thus opening up a gap between the axially inner face of the circumferential seal and the axially inner wall of the seal slot. High pressure gas from the cylinder enters the cavity under the circumferential seal and blows this oil out with the leakage into the inlet and exhaust ports.

U.S. Pat. No. 5,509,386 (Wallis et al) discloses a gas and oil sealing arrangement using an array of floating seals to affect the gas sealing and face seals to affect the oil sealing. The floating array of seals consists of two axial seals and four ring seals. The axial seals are located in slots in the cylinder head bore and the ring seals are located in grooves in the valve. Oil sealing is affected by non-rotating annular members located axially outboard of the ring seals. In this arrangement, blow-by gases leaking past the ring seal are trapped in the annular cavity formed radially between the outer diameter of the valve and the cylinder head bore, and axially between the ring seal and the non-rotating annular member. The non-rotating annular member is designed to 'blow-off' as a result of pressure build up in the annular cavity, and discharge the blow-by gases into the oil system. In practice, these blow-by gases contain unburnt fuel which when discharged into the oil system over time, heavily contaminates the oil degrading its lubricating properties. The continuous discharge of unburnt fuel into the lubricating oil system causes the volume of oil in the system to increase over time.

Although methods of ameliorating this problem are disclosed in U.S. Pat. No. 5,509,386 (Wallis), none are totally effective as they merely reduce the frequency that the non-rotating annular member is blown off the radially disposed face. The only effective solution is to eliminate the discharge of blow-by across the non-rotating annular member. One solution is disclosed that may overcome this problem but has the additional complication of two pressure relief valves per rotary valve assembly and additional plumbing.

The present invention seeks to provide a sealing system for a rotary valve assembly that ameliorates at least some of the problems of the prior art.

SUMMARY OF INVENTION

The present invention consists of a rotary valve assembly for an internal combustion engine comprising an axial flow rotary valve having a cylindrical portion, and an inlet port and an exhaust port terminating as openings in said cylindrical portion, a cylinder head having a bore in which said valve rotates about an axis with a predetermined small clearance between said cylindrical portion and said bore, a window in said bore communicating with a combustion chamber, said window being substantially rectangular in shape and said openings periodically communicating with said window as said valve rotates, bearing means journaling said valve in said bore, an array of floating seals surrounding said window, and a bias means preloading said array of floating seals against said cylindrical portion, said array of floating seals comprising at least two spaced apart elongate axial seals adjacent opposite sides of said window and at least two spaced apart arcuate circumferential seals adjacent opposite ends of said window, each said axial seal being housed in a respective axially extending axial slot formed in said bore, and each said circumferential seal being housed in a respective circumferentially extending circumferential slot formed in said bore, characterised in that said circumferential seals are axially disposed between the ends of said axial seals.

Preferably said circumferential seals extend with small clearance between the circumferentially inner faces of said axial seals. Preferably said axial slots are deeper than said circumferential slots.

Preferably said bias means comprises at least one spring disposed at an end of at least one said axial seal, said spring being substantially the same circumferential width as said axial seal and spanning between the underside of said axial seal and the root of its respective said axial slot, said spring blocking combustion gases from flowing between the underside of said axial seal and the root of its respective said axial slot past said end of said axial seal.

Preferably said spring comprises a closed end substantially axially aligned with said end of said axial seal and first and second legs extending axially from said closed end towards the middle of said axial seal, said first leg being in contact with the underside of said axial seal, and said second leg being in contact with the root of its respective said axial slot. Preferably said first leg is shorter than said second leg.

In one preferred embodiment, said spring is formed integrally with said axial seal.

Preferably there is a minimum side clearance between each said axial seal and its respective axial slot in the regions axially outside said circumferential slots. Preferably said axial seals are inclined towards said axis.

Preferably said axial slots are blind ended and there is minimal clearance between the ends of each said axial seal and the ends of its respective axial slot.

In one preferred embodiment, at least one end of at least one said axial seal and the adjacent end of its respective axial slot is spanned by a flexible member blocking the flow of combustion gases through said clearance.

In another preferred embodiment, at least one end of at least one said axial seal has a recess formed in its underside, a flexible sealing element being disposed in said recess, spanning between the sides of its respective said axial slot.

Preferably at least one said circumferential slot extends circumferentially past the circumferentially outermost side of at least one said axial slot and the said axial seal housed in said axial slot covers the intersection of the root of said circumferential slot with the circumferentially outermost side of said axial slot.

Preferably said bore has at least one radial step disposed at an end of said axial slots, the depth of said radial step being at least equal to the depth of said axial slots, said end of said axial slots being blind-ended by a sleeve abutting said radial step.

Preferably there are two said circumferential seals at each end of said window.

Preferably said valve has first and second valve seats extending radially inwards from opposite ends of said cylindrical portion, said cylindrical portion extending axially a small distance past the ends of said axial seals, said rotary valve assembly further comprising first and second sealing rings flexibly sealed to said bore and biased axially inwards against said first and second valve seats respectively.

Preferably said at least two axial seals comprise a leading axial seal and a trailing axial seal, said trailing axial seal being shorter than said leading axial seal.

Preferably said bore has at least one vent hole located axially outside said circumferential seals, axially inside said sealing rings, and circumferentially between said axial seals.

In one preferred embodiment, said vent hole communicates with a reservoir. In another preferred embodiment, said vent hole communicates with said inlet port.

In another preferred embodiment, a portion of the sealing face of at least one end of at least one said axial seal, axially outside said circumferential seals, and the area of said bore immediately adjacent to said end are both radially relieved.

Preferably said valve sealing rings are flexibly sealed by o-rings disposed between said valve sealing rings and said bore.

BEST MODE OF CARRYING OUT THE INVENTION

Figure 1:
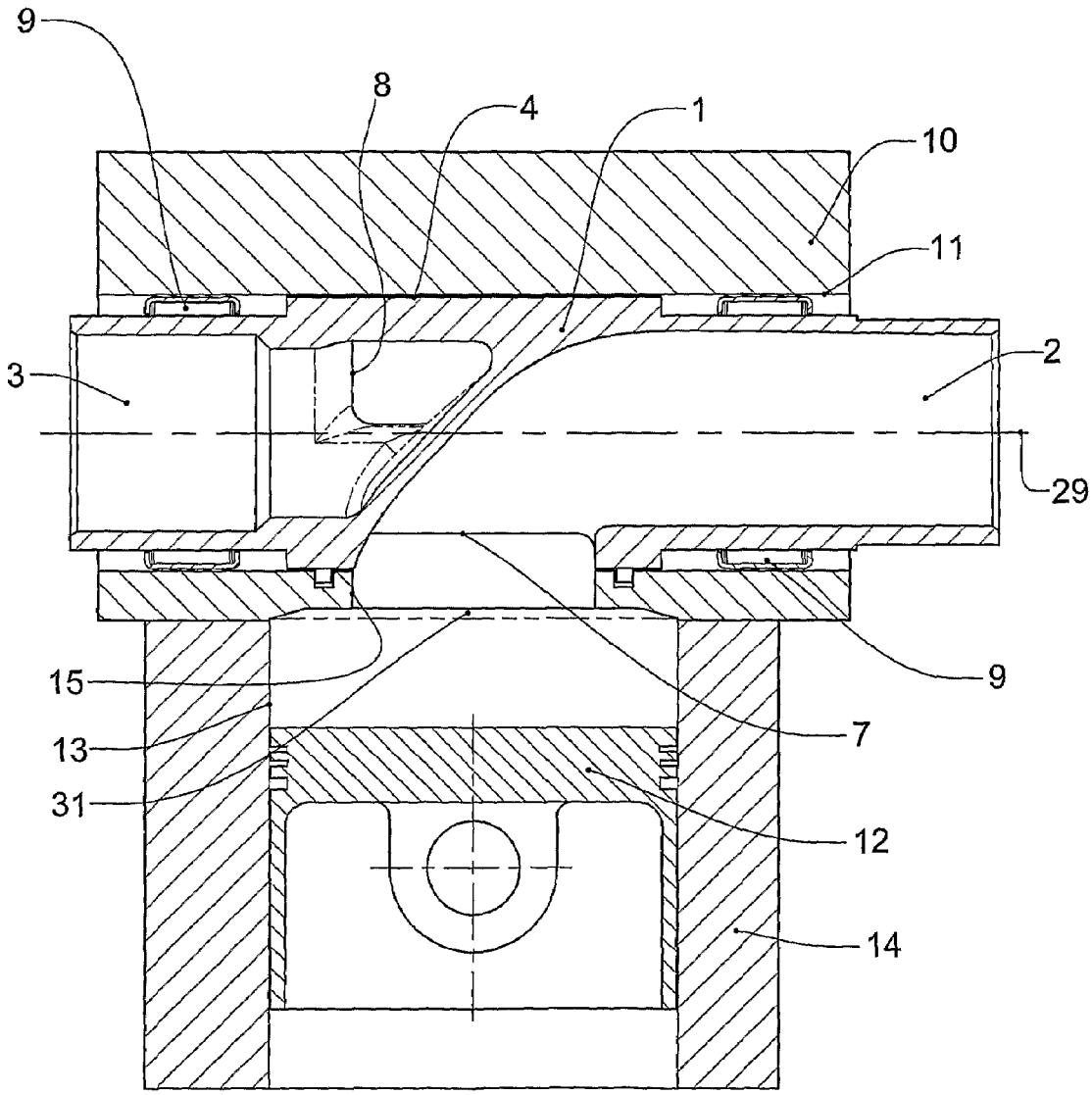
FIG. 1 is a cross sectional view of a first embodiment of a rotary valve assembly for an internal combustion engine in accordance with the present invention.

FIG. 1 depicts a rotary valve assembly comprising a valve 1 and a cylinder head 10. Valve 1 has an inlet port 2 and an exhaust port 3. The outer surface of valve 1 has a central cylindrical portion 4 of constant diameter. Inlet port 2 terminates at inlet opening 7 in cylindrical portion 4. Exhaust port 3 terminates at exhaust opening 8 in cylindrical portion 4. Exhaust opening 8 axially overlaps inlet opening 7 and is circumferentially offset to inlet opening 7. Valve 1 is supported by bearings 9 to rotate about axis 29 in cylinder head 10. Bearings 9 allow valve 1 to rotate about axis 29 whilst maintaining a small running clearance between cylindrical portion 4 and bore 11 of cylinder head 10.

Cylinder head 10 is mounted on the top of cylinder block 14. Piston 12 reciprocates in cylinder 13 formed in cylinder block 14. As valve 1 rotates, inlet opening 7 and exhaust opening 8 periodically communicate with window 15 in cylinder head 10, allowing the passage of fluids between combustion chamber 31 and valve 1.

Figure 2:
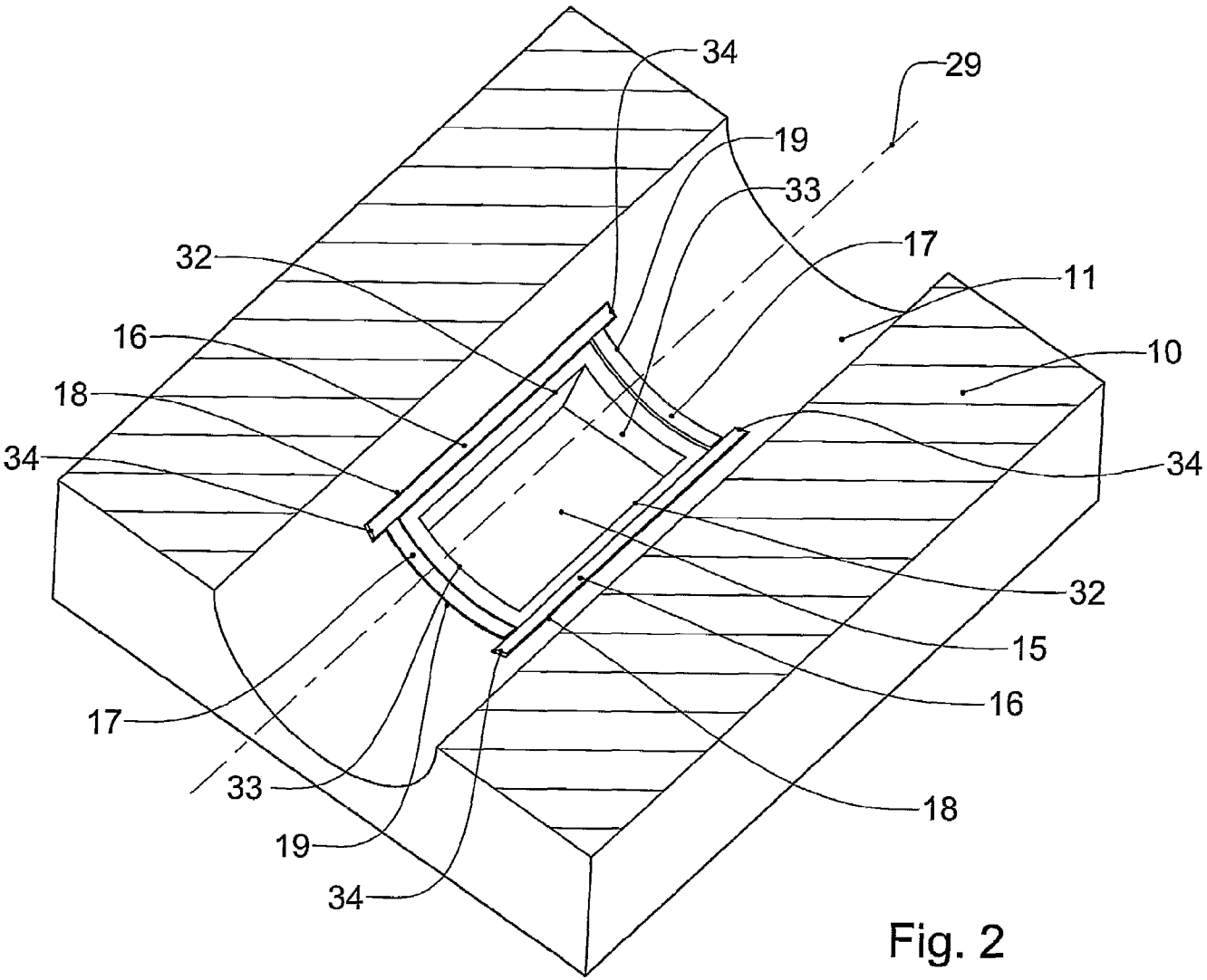
FIG. 2 is a cross sectional view through the cylinder head of the rotary valve assembly of FIG. 1 as viewed from the rotary valve side towards the cylinder showing the array of axial and circumferential seals installed in the cylinder head. For clarity, all rotary valve components apart from the seal array are removed.

FIG. 2 shows an array of floating seals, surrounding window 15, comprising axial seals 16 and circumferential seals 17 housed respectively within axial slots 18 and circumferential slots 19 in cylinder head 10. Window 15 is rectangular with sides 32 and ends 33. Axial seals 16 are substantially parallel with axis 29 and are spaced apart adjacent opposite sides 32 of window 15. Circumferential seals 17 are located in respective planes substantially perpendicular to axis 29 and spaced apart adjacent opposite ends 33 of window 15. Circumferential seals 17 are axially disposed between the ends 34 of axial seals 16. Cylindrical portion 4 slides against the array of floating seals. During the compression and power strokes, the air/fuel mixture and high pressure combustion gases in combustion chamber 31 are prevented from escaping through the small running clearance that exists between cylindrical portion 4 and bore 11 of cylinder head 10 by axial seals 16 (in the circumferential direction) and circumferential seals 17 (in the axial direction). This seal arrangement ensures that circumferential seals 17 are located close to the ends 33 of window 15 in order to minimize crevice volume.

Figure 3:
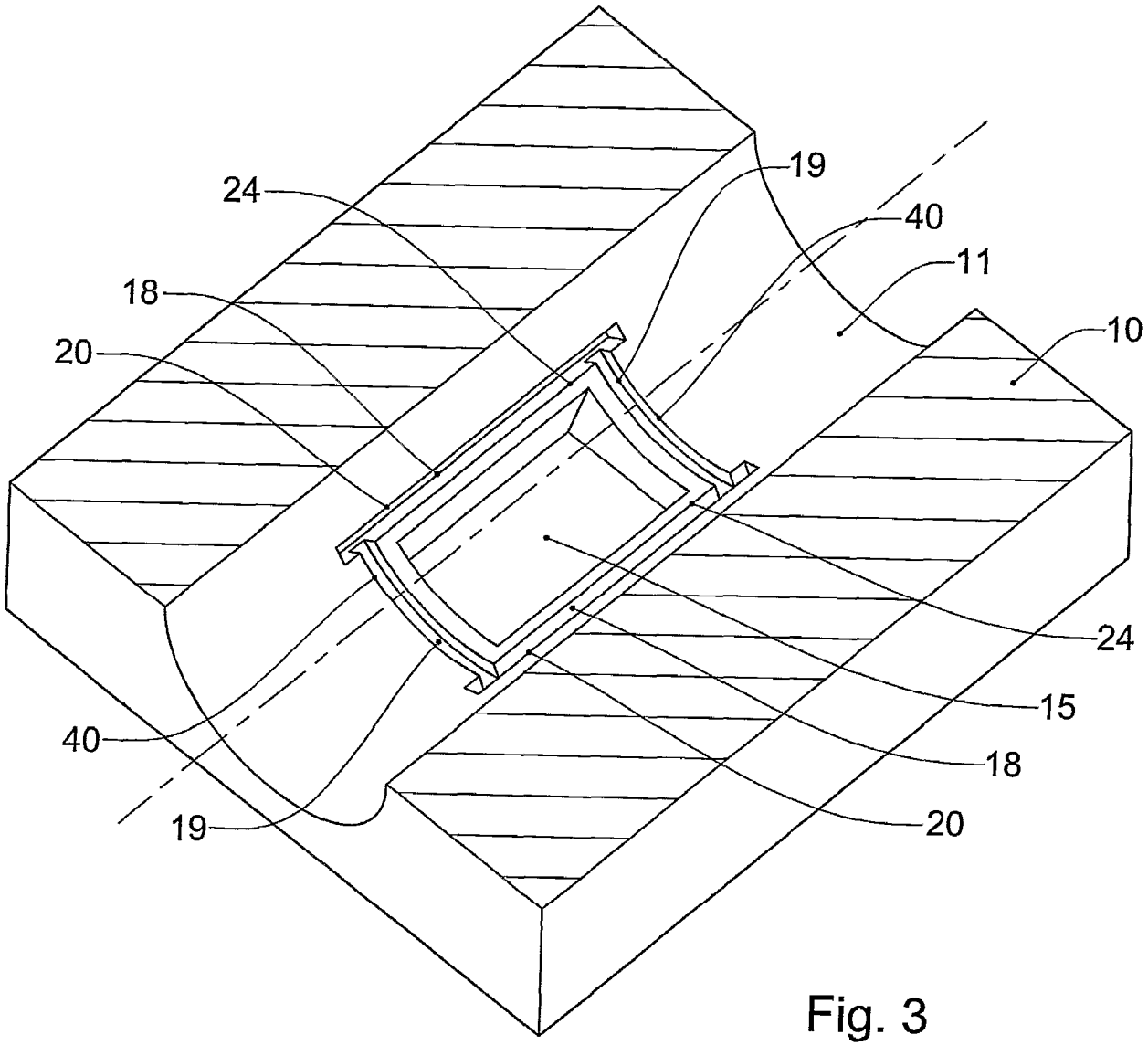
FIG. 3 is the same view as FIG. 2 with the seal array removed to reveal details of the respective seal slots.

FIG. 3 is the same view as FIG. 2 but with axial seals 16 and circumferential seals 17 removed to show details of the slots in which seals 16 and 17 are housed. Axial slots 18 are blind ended and circumferential slots 19 terminate at the sides 24 of axial slots 18 closest to window 15.

Figure 4:
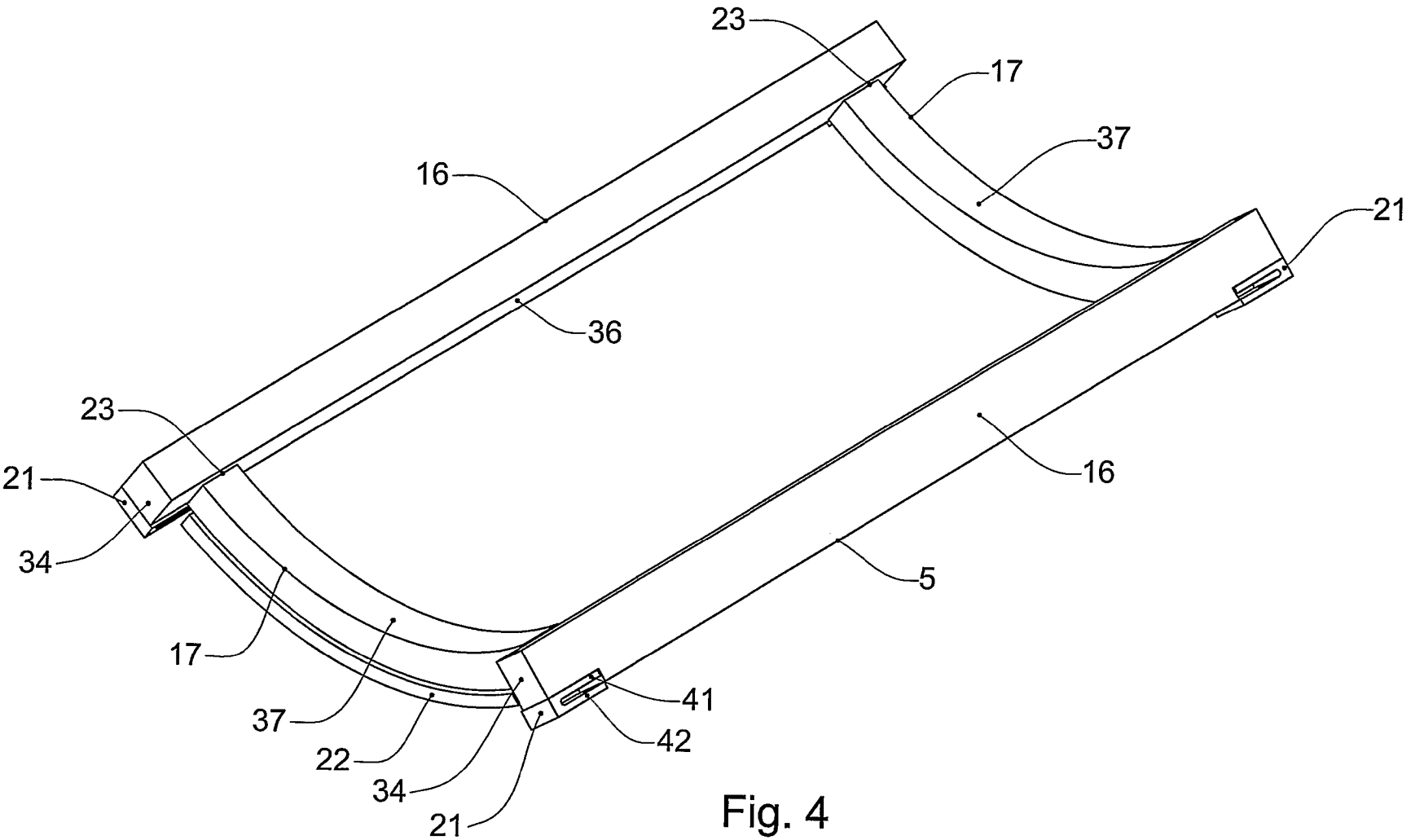
FIG. 4 is a view of the seal array of FIG. 2 with its essential elements arranged in their working positions.
Figure 5:
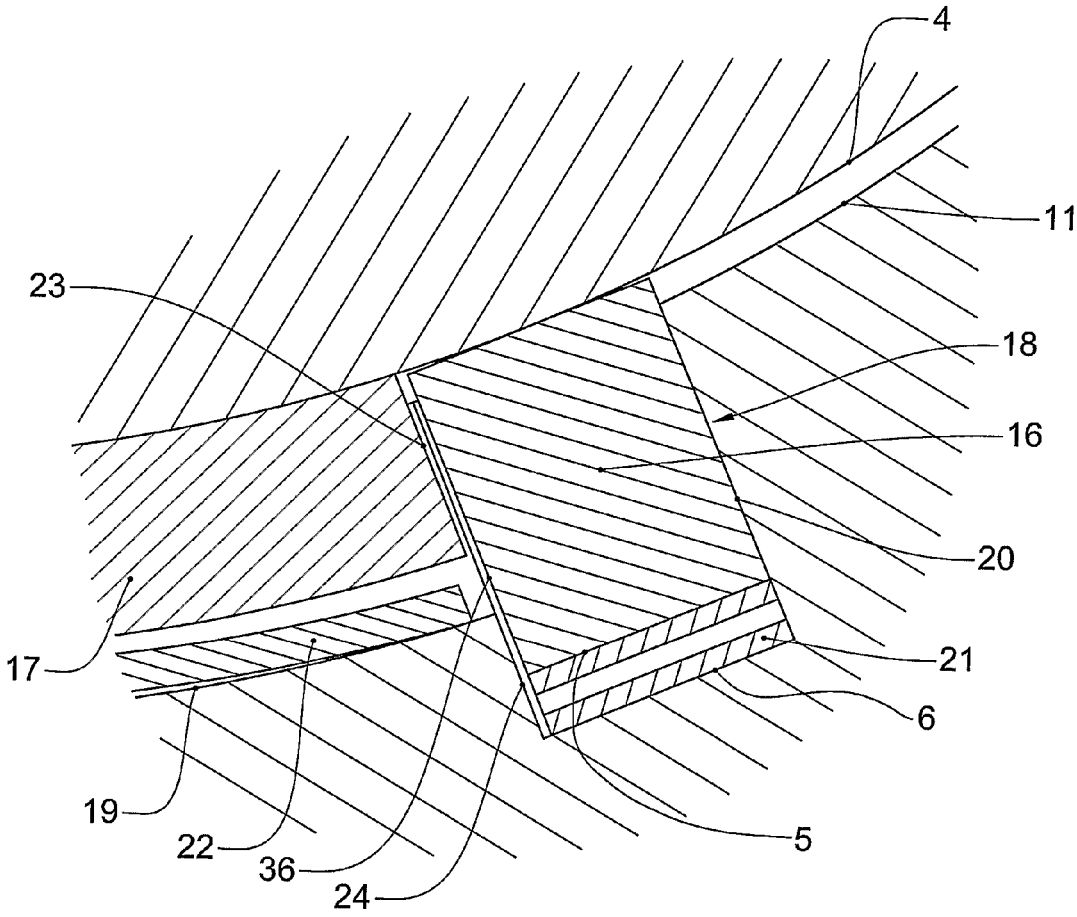
FIG. 5 is an enlarged part section view of the seal array of FIG. 2 through the centre of a circumferential seal slot.

FIG. 4 is a view of the array of floating seals showing the various sealing elements positioned relative to one another in space. Axial seals 16 are approximately rectangular in section with their radial depth greater than their circumferential width. Axial seals 16 are biased against cylindrical portion 4 of valve 1 by springs 21 at each end of each axial seal 16. Each spring 21 has a "U" shaped radial section with a closed end substantially axially aligned with the end of its respective axial seal 16, and two legs 41, 42 extending axially from the closed end towards the middle of its respective axial seal 16. Upper leg 41 contacts the underside 5 of its respective axial seal 16, and lower leg 42 contacts the root 6 of its respective axial slot 18. The circumferential width of springs 21 is substantially equal to axial seals 16. Springs 21 are designed such that the line of action between springs 21 and axial seals 16 is close to or outside the axial extremities of openings 7, 8 in valve 1. Springs 21 each span the clearance between the undersides 5 of axial seals 16 and roots 6 of axial slots 18, as shown in FIG. 5. The shape and location of springs 21 are such that they block high pressure combustion gas from flowing between the undersides 5 of axial seals 16 and roots 6 of axial slots 18, past the ends of axial seals 16 into the clearances between the ends of axial seals 16 and the adjacent ends of axial slots 18. In the embodiment shown, springs 21 and axial seals 16 are separate components. However, in other not shown embodiments, springs 21 may be formed integrally with axial seals 16. For example, these integral springs may comprise a single leg, similar to lower leg 42, extending substantially axially from the undersides 5 of the ends of axial seals 16.

Axial seals 16 are designed to have minimal end clearance and side clearance in their respective axial slots 18 consistent with reliable free radial movement of axial seals 16 in axial slots 18. The side faces 36 of axial seals 16 closest to window 15 in the region between circumferential seals 17 are exposed to hot high pressure combustion gases passing between side faces 36 of axial seals 16 and the circumferentially innermost sides 24 of axial slots 18. This portion of each axial seal 16 will inevitably accumulate carbon build up, and the side clearance must be adequate to cope with this build up without jamming axial seals 16 in axial slots 18. That portion of axial seal 16 axially outside circumferential seals 17 runs a lot cooler and is not subjected to the same carbon build up. The side clearance between this portion of axial seal 16 and its respective axial slot 18 is generally reduced as this clearance directly influences the TELA of the array of floating seals.

Thus axial seals require minimum side clearance to their axial slots in the region axially outside the circumferential slots. In the context of side clearance between the axial seal and its slot axially outside the circumferential slots, "minimum side clearance" is defined as the range of clearances between the smallest clearance consistent with the seal being able to freely move radially in the axial slot over the life of the engine, plus the necessary seal and slot manufacturing tolerances. This clearance could typically be as low as 0.01 mm. The very close proximity of side faces 36 of axial seals 16 to the circumferentially innermost sides 24 of slots 18, axially outside circumferential slots 19, means that leakage flows passing through these clearances are subject to large viscous flow losses The profile of underside 5 of axial seal 16 is matched to that of root 6 of respective axial slot 18 with cut-outs at both ends to accommodate springs 21. In order to minimise the crevice volume the design clearance between undersides 5 of axial seals 16 and roots 6 of axial slots 18 is kept to a minimum, consistent with a positive clearance being maintained under all operating and assembly conditions. The upper face of each axial seal 16 that contacts cylindrical portion 4 may be either flat or concavely arcuate to conform to cylindrical portion 4 of valve 1 on which it slides.

Circumferential seals 17 are substantially rectangular in cross section. The upper sealing surfaces 37 of circumferential seals 17 are arcuate and slightly smaller in radius than the mating cylindrical portion 4 of valve 1 on which it slides. The radial depth of circumferential seals 17 is relatively small to ensure that they can conform to the surface of cylindrical portion 4 of valve 1 and to minimise the crevice volume around circumferential seals 17. Circumferential seals 17 are biased against cylindrical portion 4 of valve 1 by means of springs 22. Springs 22 are typically constructed from a piece of flat rectangular spring steel with a width matching the width (measured axially) of circumferential seal 17. The side clearance and the radial clearance of circumferential seals 17 in their respective circumferential slots 19 is as described in reference to axial seals 16. The end clearance between the end faces 23 of circumferential seals 17 and side faces 36 of axial seals 16 is a minimum consistent with both axial seals 16 and circumferential seals 17 being able to freely move and maintain contact with cylindrical portion 4 of valve 1 under all operating conditions. Axial seals 16 and circumferential seals 17 may be made from steel.

Figure 12:
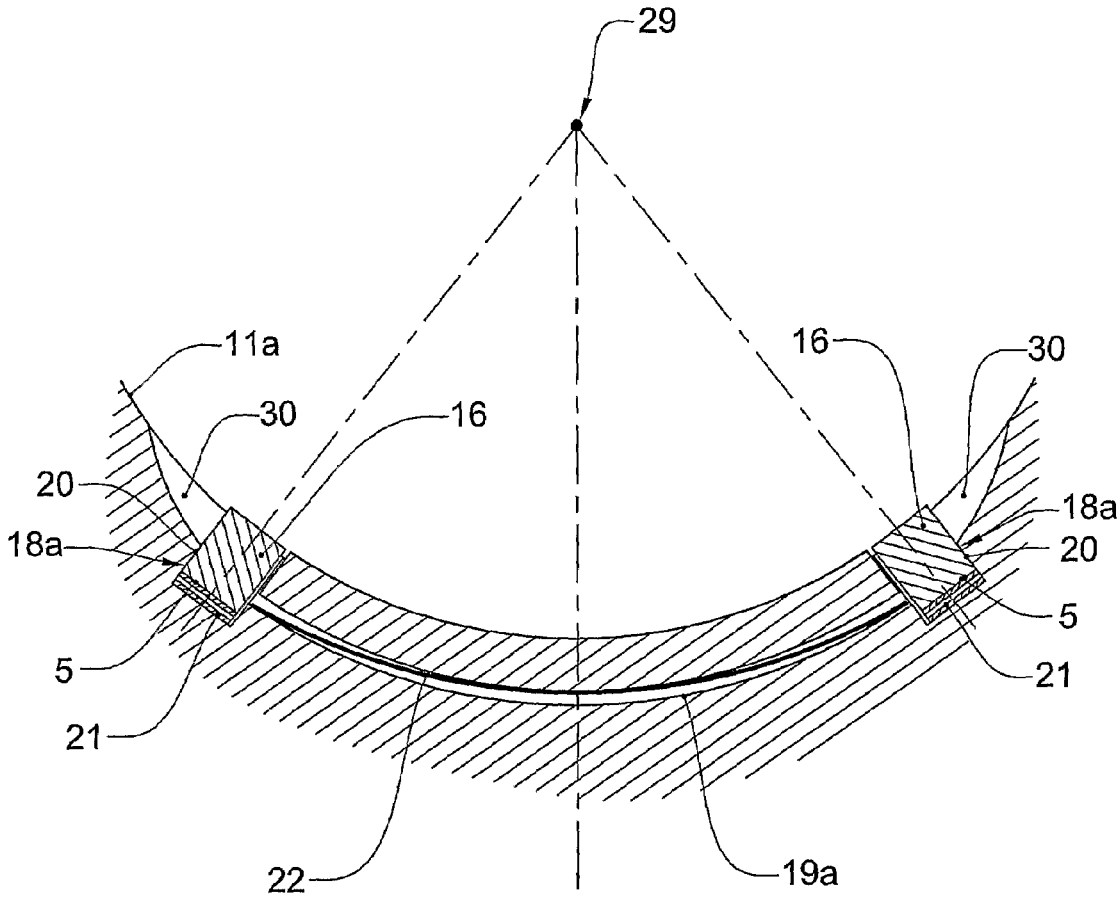
FIG. 12 is a part section through the centre of a circumferential seal slot of FIGS. 10 and 11 illustrating details of the seal array when the circumferential seal slots extend circumferentially past the axial seal slots.

FIG. 5 is an enlarged part section view of the seal array through the centre of a circumferential slot 19. Axial slots 18 are deeper than circumferential slots 19. Axial seals 16 are inclined towards axis 29 of valve 1 and preferably are radially disposed with respect to axis 29 as shown in FIG. 12. During assembly, circumferential seals 17 and their respective springs 22 are compressed towards the roots of circumferential slots 19. Axial seals 16 are then installed in axial slots 18. Circumferential seals 17 are then released, and they spring out against the sides of axial seals 16 locking them in place. This enables the seal array to be installed in bore 11 of cylinder head 10 without the need to physically restrain the seals to prevent them from being dislodged from their respective slots. This is preferable for any rotary valve seal array designed for mass production. Seals 16, 17 can be assembled into their respective slots 18, 19, locked in position in cylinder head 10 by the mechanism described above, and left in a "stable" situation until such time as valve 1 is to be assembled into bore 11 of cylinder head 10. Assembly of valve 1 into cylinder head 10, the latter which has been pre-assembled with seals 16,17, can subsequently be readily achieved by fitting a tapered sleeve over one end of valve 1 and then pushing valve 1 over the top of seals 16,17 into bore 11 of cylinder head 10.

In operation, axial seals 16 and circumferential seals 17 are biased against cylindrical portion 4 of valve 1 by means of their respective springs 21 and 22. During compression and combustion, high pressure gases enter between those faces of axial seals 16 and circumferential seals 17 that face window 15 and the adjacent sides of their respective slots 18,19, and travel to the underside of the respective seals 16, 17 where, trapped, this gas pressure forces seals 16, 17 onto cylindrical portion 4 of valve 1 with a force that is proportional to the pressure in cylinder 13.

Figure 6:
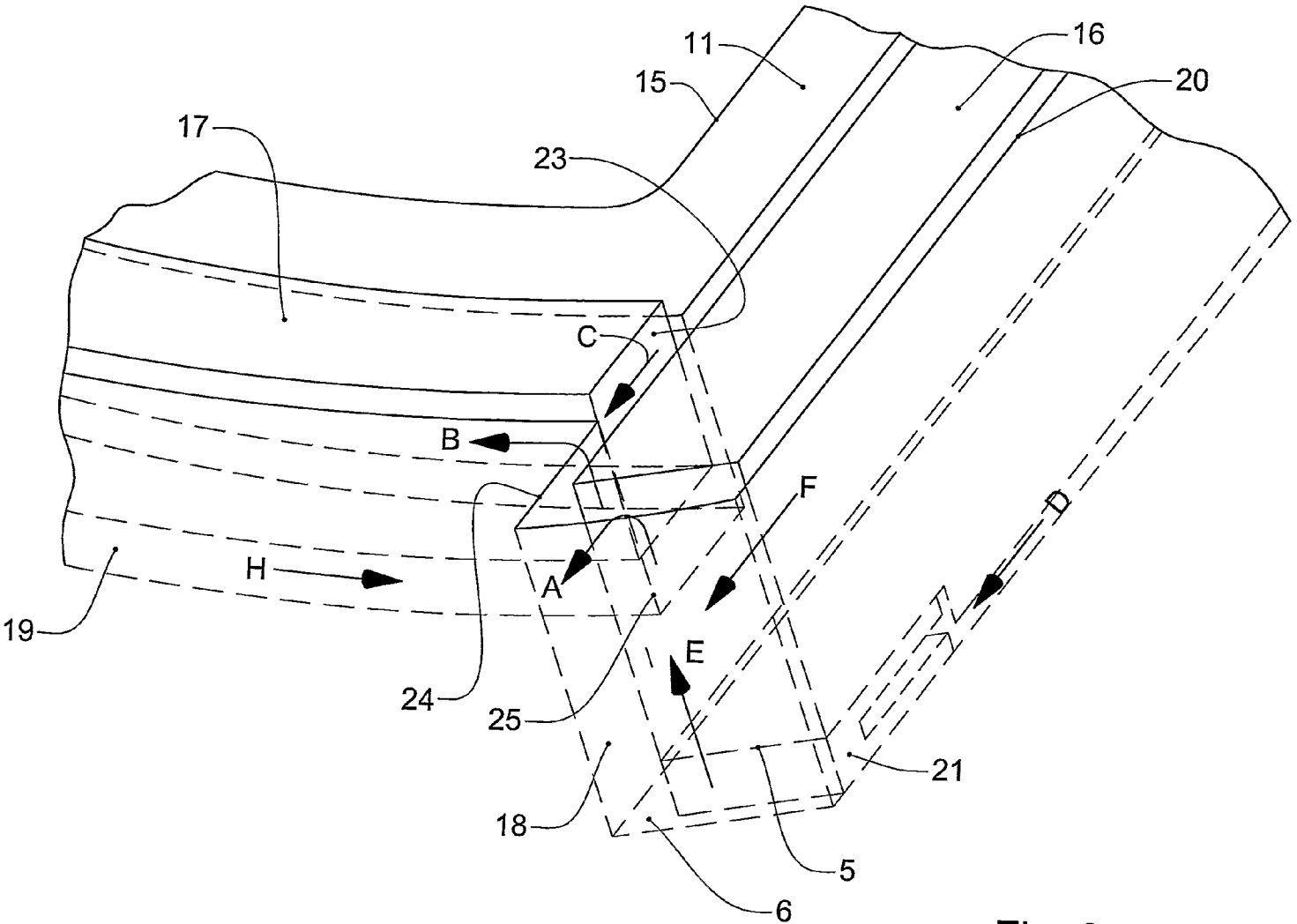
FIG. 6 is an isometric view of one corner of the seal array of FIG. 2 installed in its slots illustrating the various leakage paths that must be considered when calculating the TELA.

As described previously, it is essential that the array of floating seals has a small TELA. FIG. 6 facilitates the examination of issues relating to leakage from this seal array and is an isometric view of one corner thereof. Ultimately all leakage from the array of floating seals must result in gas flow that occurs between cylindrical portion 4 of valve 1 and bore 11 of cylinder head 10. In the array of floating seals of this embodiment comprising seals 16,17 there are three places where this leakage can occur. It can exit firstly from the end of axial slot 18 (termed "type A leakage" in this specification), secondly from the circumferentially innermost side 24 of axial slot 18 in the region outboard of circumferential seals 17 (termed "type B leakage" in this specification), and thirdly from any clearance that exists between ends 23 of circumferential seals 17 and respective axial seals 16 (termed "type C leakage" in this specification).

In order to better understand the present invention it is useful to consider an example of typical dimensions of the respective seals and slots, and their clearances to one another. These dimensions allow calculation of relevant leakage areas. The following dimensions and clearances are assumed for all future discussions of leakage area in this specification.

Axial seal 16: Length=90 mm, circumferential width=2 mm, radial depth=4 mm, clearance between the underside 5 of axial seal 16 and root 6 of axial slot 18 in the working position=0.30 mm, side clearance of axial seal 16 in axial slot

18 in the area axially outboard of circumferential slot 17=0.01 mm, end clearance of axial seal 16 in axial slot 18=0.05 mm (each end) cold and 0.10 mm (each end) hot.

Circumferential seal 17: Axial width=3.0 mm, clearance between end 23 of circumferential seal 17 and adjacent axial seal 16=0.10 mm (each end), clearance between underside of circumferential seal 17 and circumferential slot 19 in working position=0.30 mm, overlap of axial slot 18 past circumferential slot 19=2.5 mm (each end).

Cylinder head 10: Radial clearance between cylindrical portion 4 and bore 11 of cylinder head 10=0.10 mm.

Type A, B and C leakage will all discharge high pressure gas into an area between cylindrical portion 4 and bore 11 of cylinder head 10. Type A leakage typically will have an escape area (between cylindrical portion 4 and bore 11) of $4\times(2\times0.10)=0.8\ mm^2$ (the factor 4 accounts for the 4 corners of seal array 16, 17). Type B leakage will typically have an escape area of $4\times(2.50\times0.1)=1.0\ mm^2$. Type C leakage will typically have an escape area of $4\times(0.10\times0.10)=0.04\ mm^2$. As type C leakage is relatively small and discharges into the same area as the type B leakage, it will be ignored. Typically the "type A & B leakage" area is therefore $1.8\ mm^2$.

However this type A & B leakage area of $1.8\ mm^2$ is very large compared to the TELA of the prior art sealing system disclosed in U.S. Pat. No. 5,526,780 (Wallis). Leakage areas of this magnitude would be unacceptable in any modern internal combustion engine. This example demonstrates how the present invention addresses this problem by controlling those flow areas that directly or indirectly feed the type A & B leakage.

Type A leakage is predominately fed by gas that flows under axial seal 16 (flow D) and up between the end of axial seal 16 and the end of axial slot 18 (flow E). The typical feed area under axial seals 16 is $4\times(2\times0.30)=2.4\ mm^2$. The typical feed area between the end of axial seal 16 and the end of axial slot 18 is $4\times(2\times0.05)=0.4\ mm^2$.

Typically the housing is made of aluminium and the axial seals from steel. Consequently, by the time the assembly has reached operating temperature, it is easy to calculate that the thermal expansion difference between axial seals 16 and axial slots 18 will increase the clearance between the end of the seals and the seal slots by 0.10 mm (or 0.05 mm at each end). This differential thermal expansion will effectively double the feed area referred to above to $0.8\ mm^2$. In this case the feed areas are equal to the type A leakage area. Consequently, the type A or type E leakage area will be the controlling leakage area depending on the details of the seal pack.

Type B leakage is fed by leakage flowing between inner face 36 of axial seal 16 and the adjacent circumferentially innermost side 24 of axial slot 18 (flow F). At the edge 25 formed by the intersection of axial slot 18 with the axially outermost face of circumferential slot 19, this flow area is typically $4\times(4\times0.01)=0.16\ mm^2$. Once this leakage has passed edge 25, it must then travel upward to reach the type B leakage area. This area is typically $4\times(2.5\times0.01)=0.1\ mm^2$. As this feed area is much smaller than the type B leakage area, it is this feed area that controls the effective leakage area. The seal array geometry described above therefore has a TELA of $0.8\ mm^2+0.1\ mm^2=0.9\ mm^2$.

This embodiment introduces springs 21 which effectively span the clearance which exists between the underside 5 of axial seals 16 and root 6 of axial slots 18 axially outboard of, or adjacent to, circumferential seals 17. This effectively blocks the leakage flow D under axial seal 16 that feeds the type A leakage area. In this situation the type A leakage can only be fed by leakage flow F between the inner face 36 of axial seal 16 and the adjacent circumferentially innermost side 24 of axial slot 18. Thus both type A and type B leakage are being fed from the same source. The TELA is therefore $0.16\ mm^2$ or 18% of the arrangement without these springs 21. This leakage flow is subject to large viscous losses and consequently the calculated TELA is a considerable overstatement of the effective leakage area.

A more efficient design may be obtained by reducing the axial seal end clearance to a minimum in conjunction the spring arrangement outlined above. In this context "minimum end clearance" is defined as the range of clearances between the smallest clearance consistent with the seal being able to freely move radially in the axial slot over the life of the engine and this clearance plus the necessary seal and slot manufacturing tolerances.

The exact location of spring 21 depends on the details of the spring and the circumferential slot 19. Spring 21 must be of a shape and positioned such that it blocks any flow H (between the underside of circumferential seal 17 and root of circumferential slot 19) being delivered into the area between underside 5 of axial seal 16 and root 6 of axial slot 18, such that it feeds flow E.

Springs 21 must have substantially the same circumferential width as axial seals 16 to ensure all of flow D is blocked from feeding flow E. The line of action between each spring 21 and its respective axial seal 16 acts either close to or outside the axial extremities of openings 7,8 in valve 1 in order to ensure that there is no significant force acting on axial seal 16 tending to push axial seal 16 radially inward into openings 7,8 during rotation of valve 1.

The perimeter of circumferential seals 17 according to the present invention is approximately one quarter (¼) of that of the prior art arrangement disclosed in U.S. Pat. No. 5,526,780 (Wallis). The crevice volume under circumferential seal 17 is reduced by a similar ratio. As only one circumferential seal 17 is required at each axial end of window 15, instead of the two used in U.S. Pat. No. 5,526,780 (Wallis), the crevice volume associated with the circumferential seal in its respective circumferential seal slot is potentially further halved. Crevice volume associated with the circumferential sealing elements is potentially one eighth that of the arrangement disclosed in U.S. Pat. No. 5,526,780 (Wallis).

The reduction in this perimeter and the number of seals required, combined with the geometry of the seals, has a direct impact on the rotational friction losses associated with these seals and hence the friction associated with valve 1 as it rotates in bore 11. Friction losses associated with circumferential seals 17 of the present invention can be shown to be less than one eight (⅛) of those of the ring seal arrangement disclosed in U.S. Pat. No. 5,526,780 (Wallis).

Figure 7:
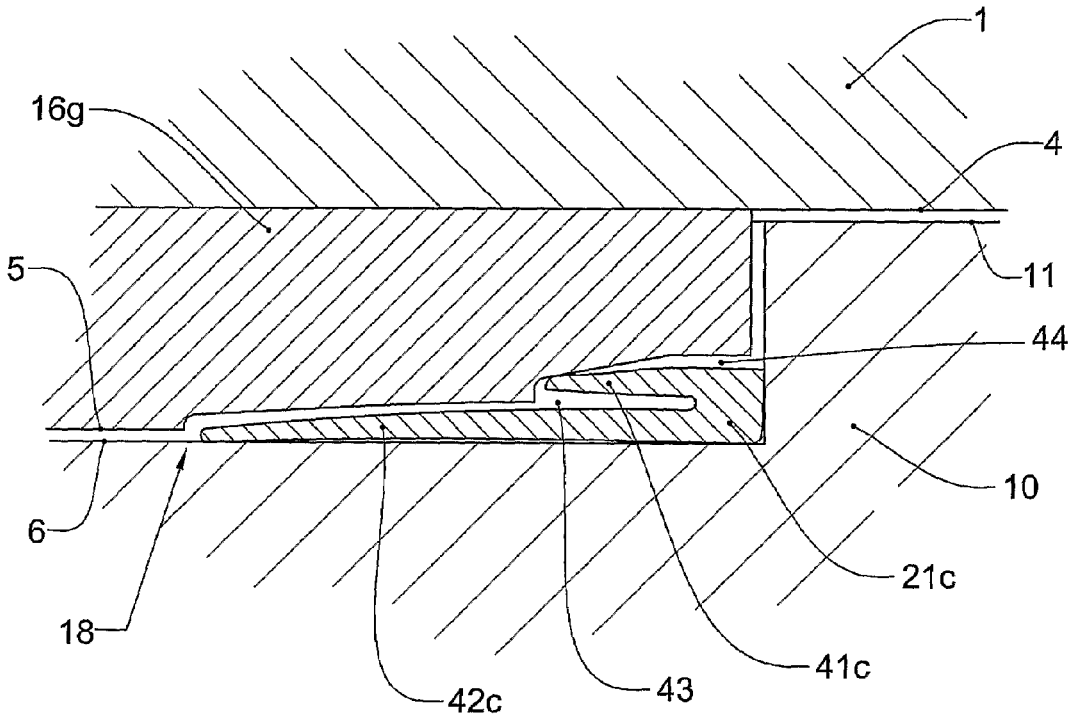
FIG. 7 is a part section through the centre of one end of an axial slot of a second embodiment of a rotary valve assembly in accordance with the present invention, showing details of an alternative spring design.

FIG. 7 is a part section through the centre of one end of an axial slot 18 of a second embodiment of a rotary valve assembly in accordance with the present invention, showing details of an alternative spring design. Spring 21*c* is different to that previously shown in that the upper leg 41*c* is shorter than the lower leg 42*c*. Spring 21*c* has the advantage that it maximises the allowable spring movement whilst maintaining the line of action of the spring on axial seal 16 close to or outside openings 7, 8 and maintaining an acceptable stress level within the spring. The short upper leg 41 applies the radial load to axial seal 16 outside openings 7, 8. The longer lower leg 42 provides the necessary radial movement required to ensure an adequate spring force is applied to axial seal 16 in all operating conditions.

Figure 8:
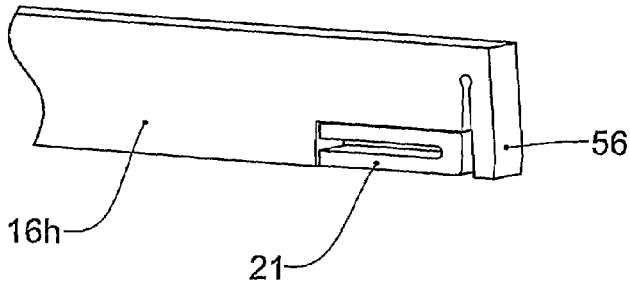
FIG. 8 is an isometric view of an alternative axial seal arrangement.

A function of the springs 21 as described above is to block the flow of combustion gases between the undersides 5 of the axial seals 16 and the roots 6 of the axial slots 18 to the area between the ends 34 of the axial seals 16 and the ends of the adjacent axial slots 18. However, the blocking of this flow may be achieved by other mechanisms such as the alternative axial seal arrangement shown in FIG. 8. Axial seal 16h has a flexible member at its end in the form of arm 56 which is sprung axially outward such that when it is assembled into axial slot 18, arm 56 is preloaded against the end of the axial slot 18 thus blocking flows under axial seal 16*h* from reaching the type E flow area.

Figure 9:
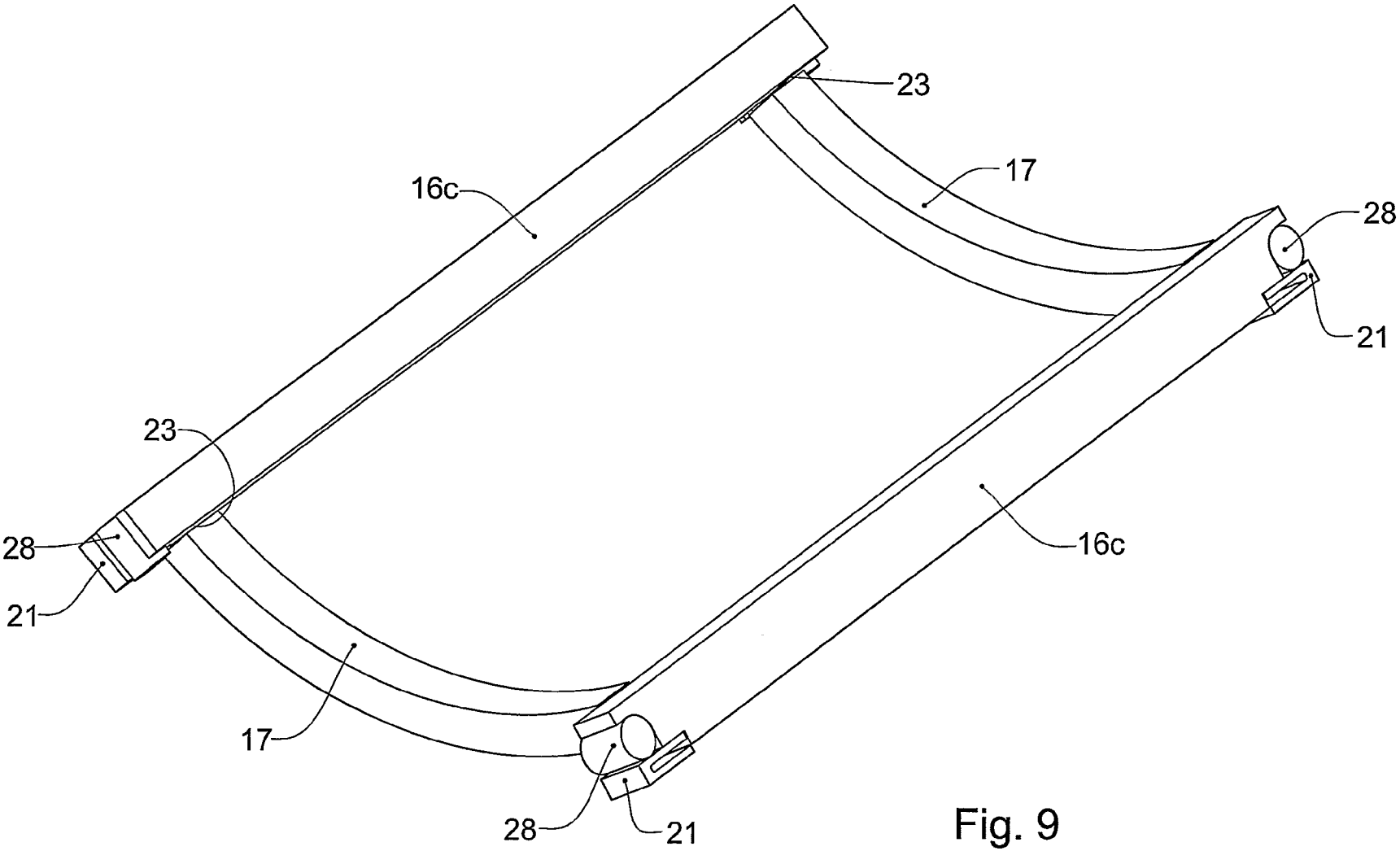
FIG. 9 is a view of a seal array of a third embodiment of a rotary valve assembly in accordance with the present invention.

In the event that further reduction in the TELA is required, additional flexible elements may be introduced above springs 21. The third embodiment of the present invention shown in FIG. 9 has flexible elements in the form of cylindrical seals 28 which are located above and in contact with springs 21. Cylindrical seals 28 are disposed in recesses formed in the underside of the ends of axial seals 16*c*. Cylindrical seals 28 have a width close to that of axial slots 18 and are made from an elastomeric material such as rubber. When assembled, seals 28 span between the circumferentially innermost sides 24 and circumferentially outermost sides 20 of axial slots 18. Cylindrical seals 28 block the type F leakage area that feeds the type A & B leakage area. In the event there is 1 mm between the top of cylindrical seals 28 and the top of axial seals 16*c*, the feed area is approximately reduced to $4\times(1\times0.01)=0.04$ $mm^2$. The TELA of this arrangement is now 0.04 $mm^2$ or less than that of a conventional piston ring. As before, the large viscous losses incurred by flow type F means that this is a considerable overstatement of the effective leakage area.

Cylindrical seals 28 will operate satisfactorily despite the fact they are blocking the flow of hot combustion gases. These gases are relatively cool due to their distance from the spark plugs and the low flow rate past cylindrical seals 28 as a consequence of the low TELA. When combustion commences and the cylinder pressure starts to rise, unburned gas (which is relatively cool) is pushed into the area where cylindrical seals 28 are located. This cool gas, which cannot be burned in such a confined space, acts as an insulating layer against the hot combustion gases and is the reason that cylindrical seals 28 are capable of surviving an otherwise hostile environment.

Figure 10:
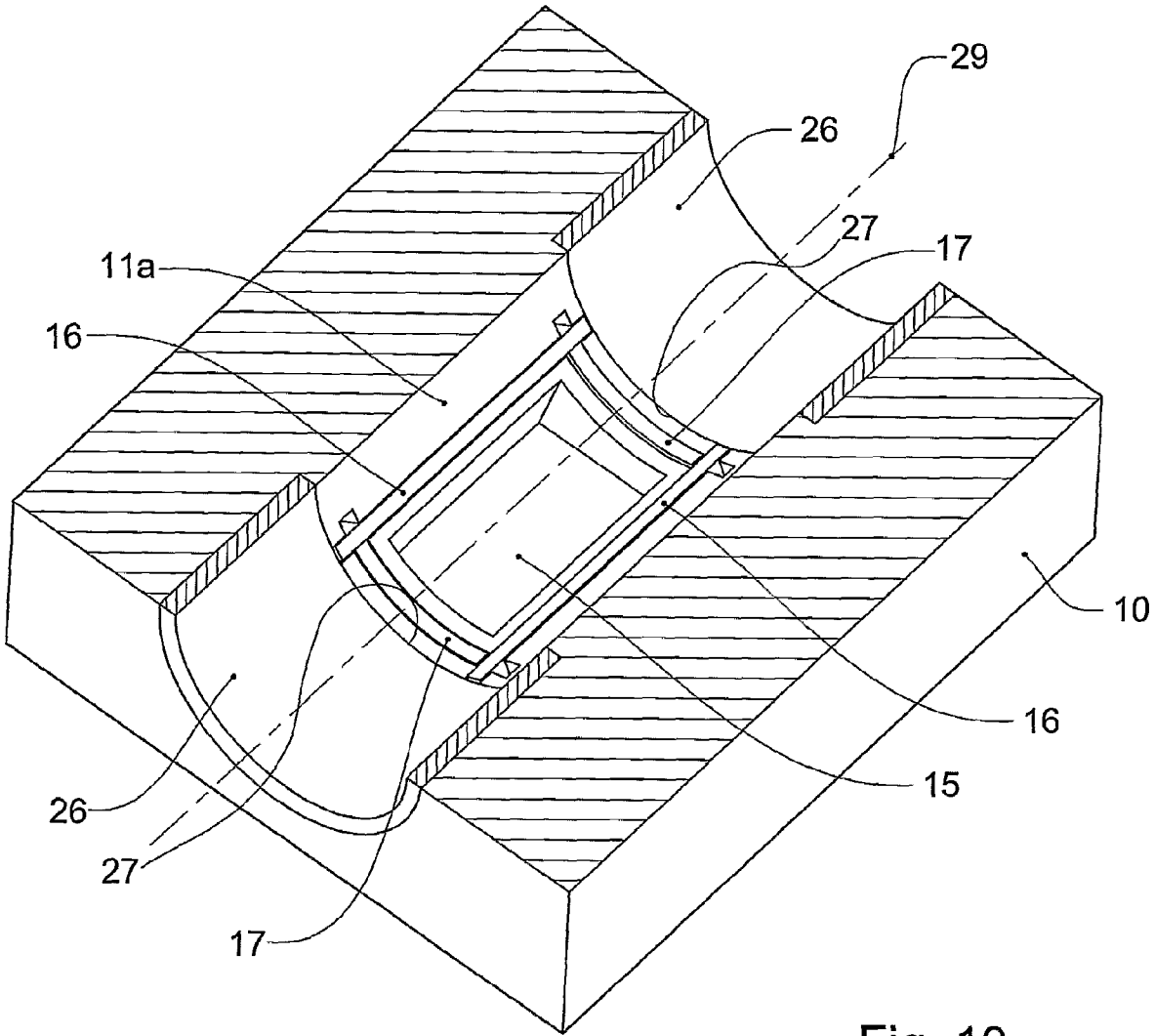
FIGS. 10 and 11 show sections of a fourth embodiment of a rotary valve assembly in accordance with the present invention.
Figure 11:
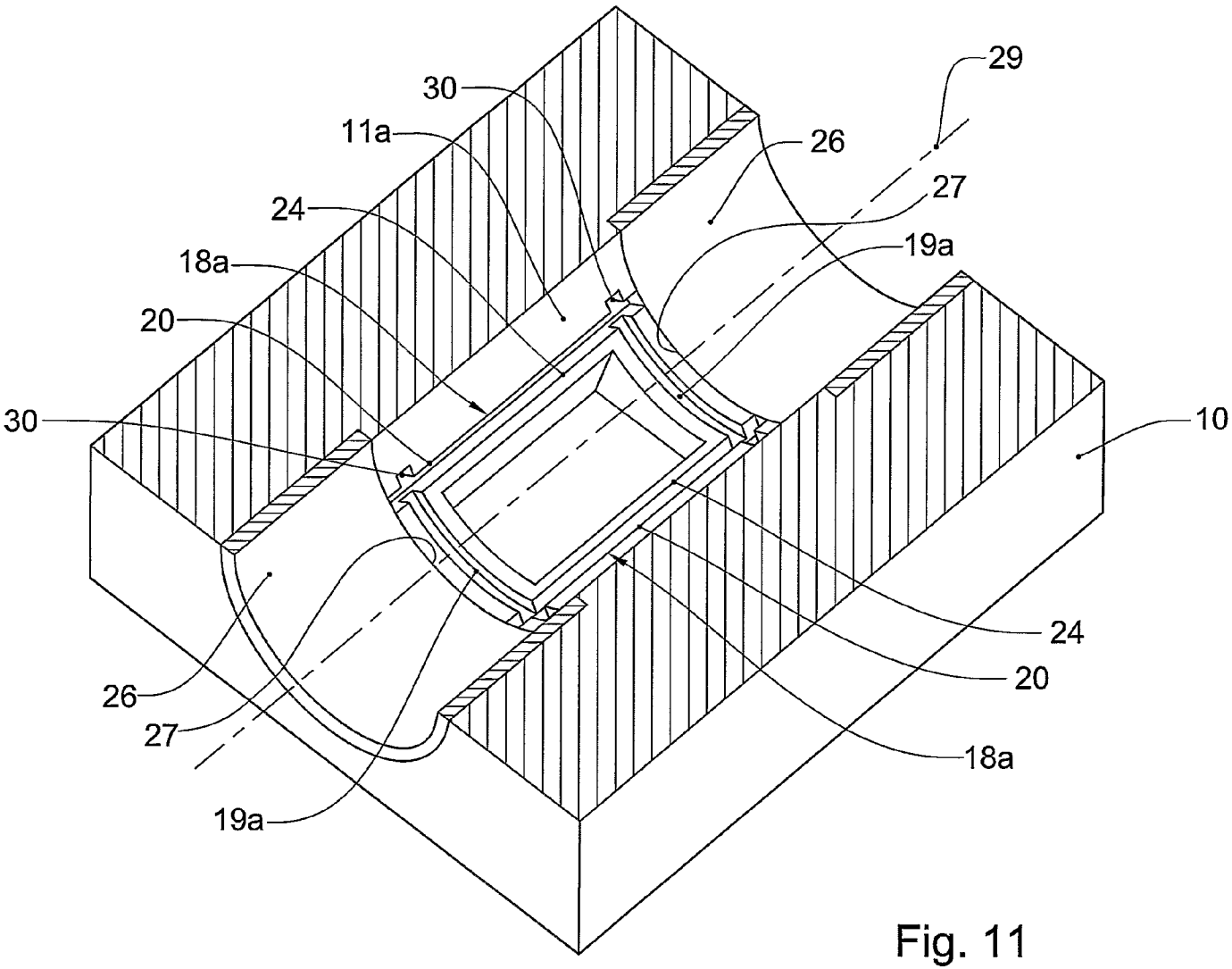

FIGS. 10 and 11 show sections of a fourth embodiment of a rotary valve assembly in accordance with the present invention. FIGS. 10 and 11 are the same views as FIGS. 2 and 3 respectively, but with modifications added to enable mass production machining techniques to be utilised in the manufacture of the axial slots and circumferential seal slots. The seal slots previously discussed in reference to FIGS. 2 and 3 are square ended slots that require the use of techniques not generally associated with mass production to manufacture. Typically these square ended slots are manufactured using an EDM (electro discharge machining) process which is time consuming and expensive.

Bore 11*a* has been stepped at both ends of cylinder head 10. This radial step is deeper than the depth of axial slots 18*a*. Consequently axial slots 18*a* can be manufactured rapidly and economically by through-broaching the minimum diameter portion (i.e. the non-stepped portion) of bore 11*a* in the axial direction. After axial slots 18*a* have been broached, tubular sleeves 26 are inserted into the stepped portion of bore 11*a*. Sleeves 26 are an interference fit in bore 11*a* and their axially innermost faces 27 abut the ends of axial slots 18*a*, thus forming blind-ended slots.

In FIGS. 10 and 11 circumferential slots 19*a* extend circumferentially past the circumferentially outermost sides 20 of axial slots 18*a*, which are the sides of slots 19*a* that are remote from window 15. This allows circumferential slots 19*a* to be machined using a rotating milling cutter with a rotational axis substantially parallel to axis 29. The portion of circumferential slots 19*a* formed circumferentially outside axial slot 18*a* is henceforth referred to as circumferential seal slot extension 30.

FIG. 12 is a section through circumferential slot 19*a*. Circumferential seal slot extension 30 intersects sides 20 of axial slots 18*a* remote from window 15 above the underside 5 of axial seals 16, such that axial seals 16 cover the intersection of slot extension 30 with sides 20. Consequently, the gas pressure loading axial seals 16 against sides 20 of axial slot 18*a* form a seal preventing high pressure gas being conveyed into circumferential seal slot extension 30. Irrespective of this, circumferential seal slot extension 30 should be designed to "wash out" into bore 11*a* as close as possible to axial seal 16, consistent with a practical size of milling cutter being used to generate circumferential slot 19*a*.

Figure 13:
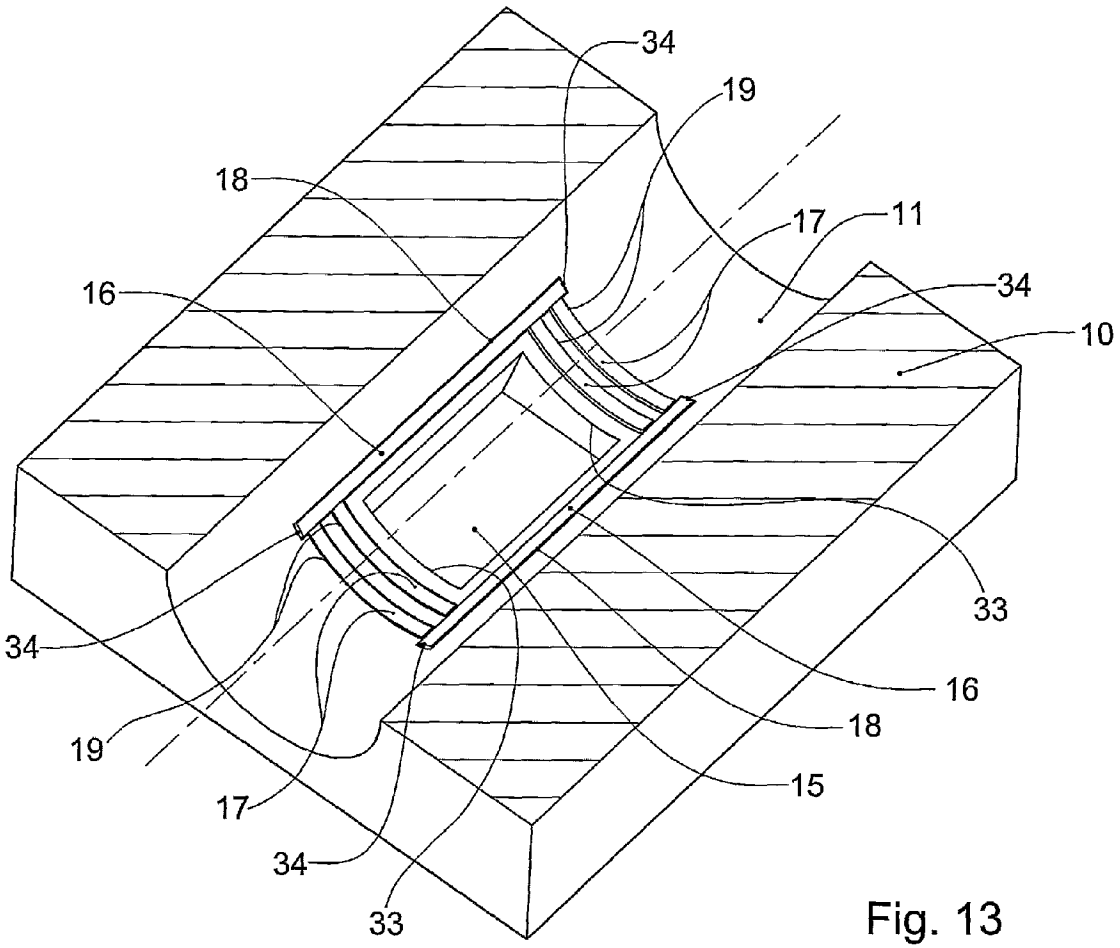
FIG. 13 shows a section through a fifth embodiment of rotary valve assembly in accordance with the present invention.

FIG. 13 shows a section through a fifth embodiment of rotary valve assembly in accordance with the present invention. The seal array of FIG. 13 is the same as that depicted in FIG. 2, except that there are two circumferential seals 17 and corresponding circumferential slots 19 at each end of window 15, giving a total of four circumferential seals 17. All of the circumferential seals 17 are still axially located between the ends 34 of axial seals 16. The additional circumferential seals 17 improve the level of sealing in certain applications of the present invention, in a similar manner to that of a second (or indeed third) compression ring in a piston.

Figure 14:
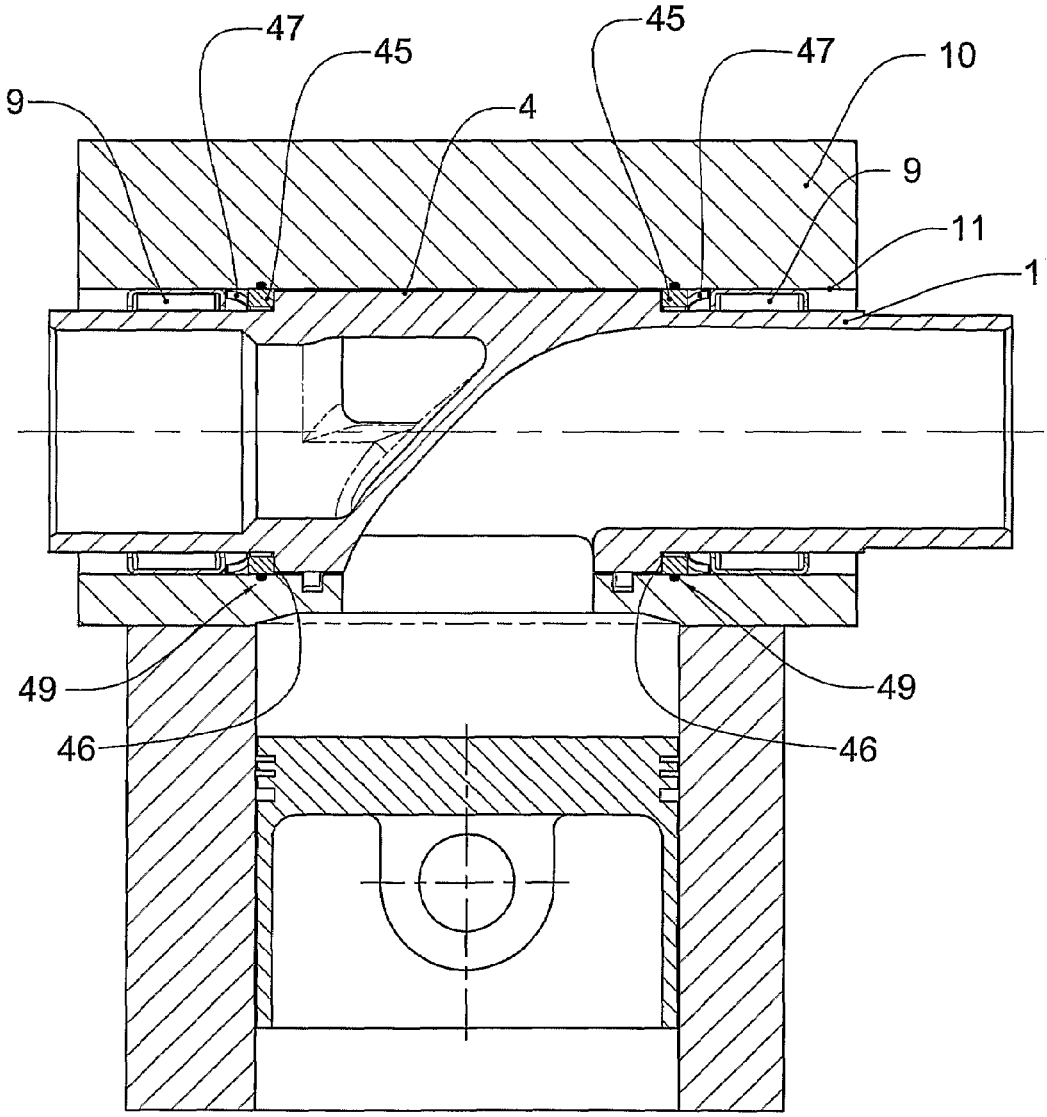
FIG. 14 is a cross sectional view of a sixth embodiment of a rotary valve assembly for an internal combustion engine incorporating an oil sealing system in accordance with the present invention.
Figure 15:
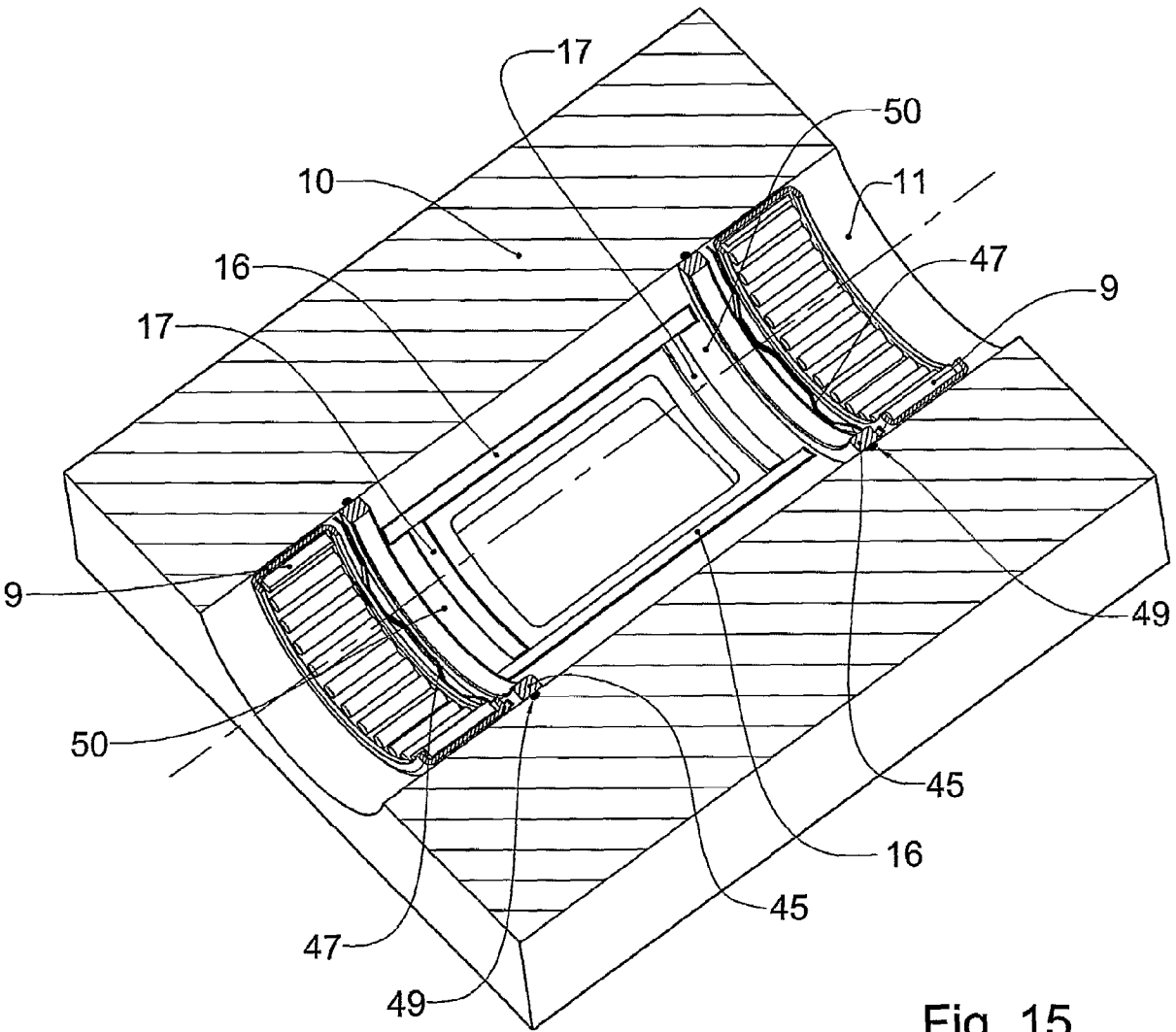
FIG. 15 is a cross sectional view through the cylinder head of the rotary valve assembly of FIG. 14 as viewed from the rotary valve side towards the cylinder. For clarity, all rotary valve components apart from the seals and bearings are removed.
Figure 16:
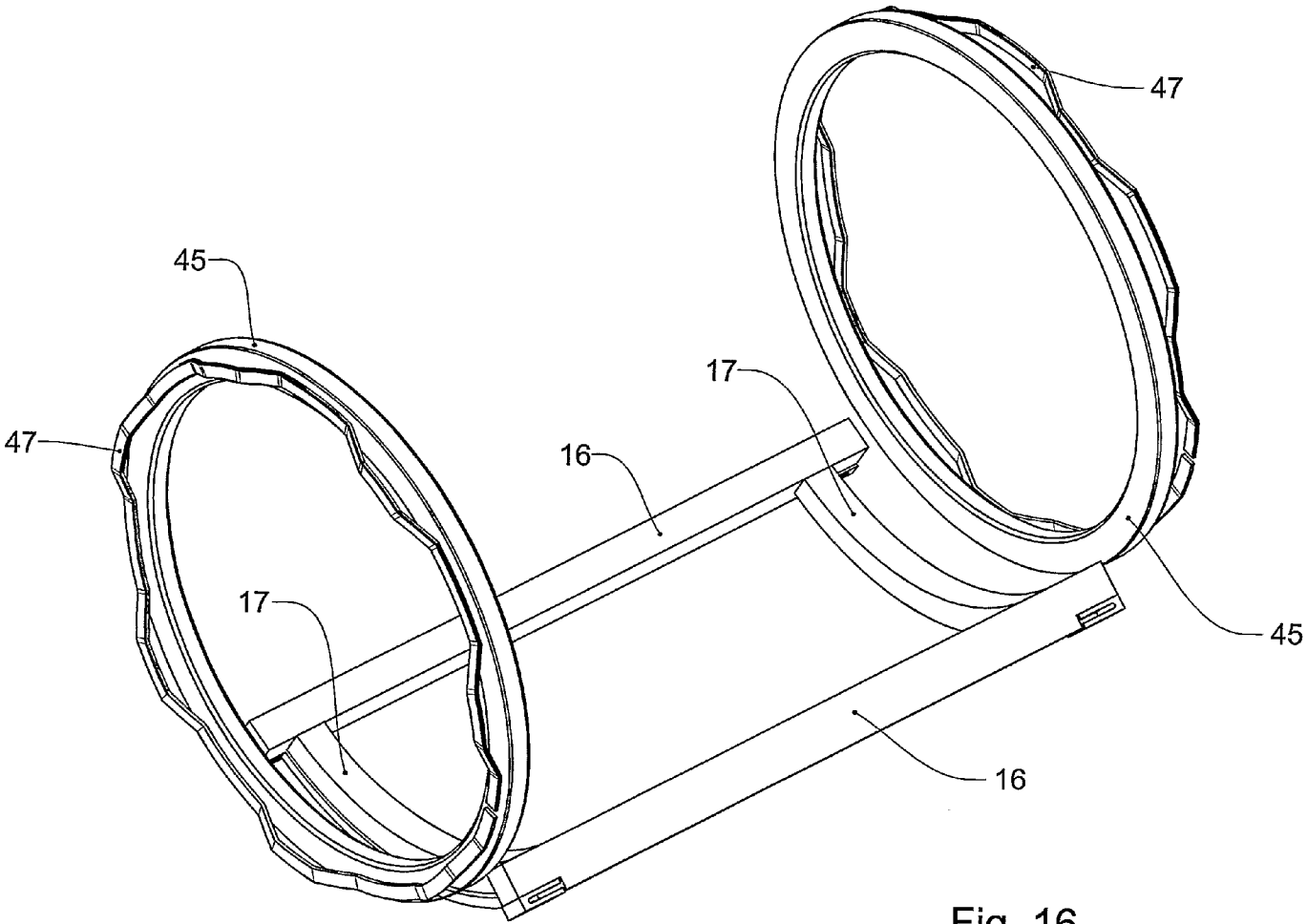
FIG. 16 is a view of the gas and oil sealing elements of FIG. 14 and FIG. 15 arranged in their working positions.

FIGS. 14, 15 and 16 show a sixth embodiment of a rotary valve assembly in accordance with the present invention. This embodiment has the same gas sealing array as the first embodiment shown in FIG. 1 with the addition of a face seal arrangement comprising two valve sealing rings 45, O Rings 49, valve seats 46 and face seal springs 47.

Central cylindrical portion 4 of valve 1 extends axially a small distance past the axial extremities of the array of floating seals that perform the gas sealing function. Valve 1 steps radially inwards either side of central cylindrical portion 4 forming two radial faces that extend radially inwards from central cylindrical portion 4 forming valve seats 46. Valve sealing rings 45 are annular in shape and biased axially inwards against a respective valve seats 46 by face seal springs 47. Face seal springs 47 have a wave like form and act on the axially outer faces of valve sealing rings 45. Valve sealing rings 45 are flexibly sealed to bore 11 by o-rings 49, each located in a respective circumferential groove in bore 11. O-rings 49 seal on the outside diameter of sealing rings 45 whilst still allowing sealing rings 45 to move axially. Alternatively, the o-ring 49 may be housed in the outside diameter of valve sealing rings 45 and seal to bore 11.

The face seal formed between the axially inwards faces of valve sealing rings 45 and valve seats 46 prevents lubricating oil from entering cylindrical portion 4, and prevents blow-by gases from the seal array from discharging into the oil.

As discussed above, the gas sealing arrangement of the present invention has a low TELA but there is still a small amount of leakage past the seal array. Ultimately all leakage past the array of floating seals must result in gas flows that occurs between the cylindrical portion 4 of valve 1 and bore 11 of cylinder head 10. Unlike U.S. Pat. No. 5,509,386 (Wallis) the blow-by is discharged into leak cavities 50 (FIG. 15), from where it can be disposed of without the need to blow the non-rotating annular member off the radially disposed face it seats against. Consequently, the unburnt fuel in the blow-by is no longer discharged into the engine oil and consequently unable to contaminate the engine oil.

Gas leakage types A, B and C, as defined above with reference to FIG. 6, discharge into leak cavities 50 bound radially between cylindrical portion 4 and bore 11, axially between circumferential seals 17 and adjacent valve sealing rings 45 and circumferentially between the outer circumferential sides 20 of axial seals 16. Blow-by deposited into leak cavity 50 can discharge from leakage cavity 50 through the passages formed between the axial extremities of the axial seals 16 and the valve sealing rings 45. The flow area of these passages must be sufficient to allow the blow-by to escape from leak cavity 50 without the pressure in this cavity building up sufficiently to unseat the valve sealing ring 45 from its valve seat 46. This is particularly important as unlike the face seal arrangement disclosed in U.S. Pat. No. 5,509,386 (Wallis) only a small portion of the valve sealing ring 45 is pressurised and it will be tilted in the event it is unseated. Not only does this result in leakage of raw fuel into the engine oil it also allows the engine oil to leak into the central cylindrical portion 4.

Gases vented from leak cavities 50 can then travel through the clearance between cylindrical portion 4 and bore 11 to either inlet opening 7 or exhaust opening 8. It is preferred that vented gases are disposed of through inlet opening 7 rather than exhaust opening 8. Gases disposed of through inlet opening 7 enter inlet port 2 and are thus harmlessly recycled back into the cylinder on the following inlet stroke. On the other hand, unburnt hydrocarbons in the gases disposed of through exhaust opening 8 may or may not be burnt in the exhaust. If not, then the unburnt hydrocarbons contribute to the emissions of the engine.

Figure 17:
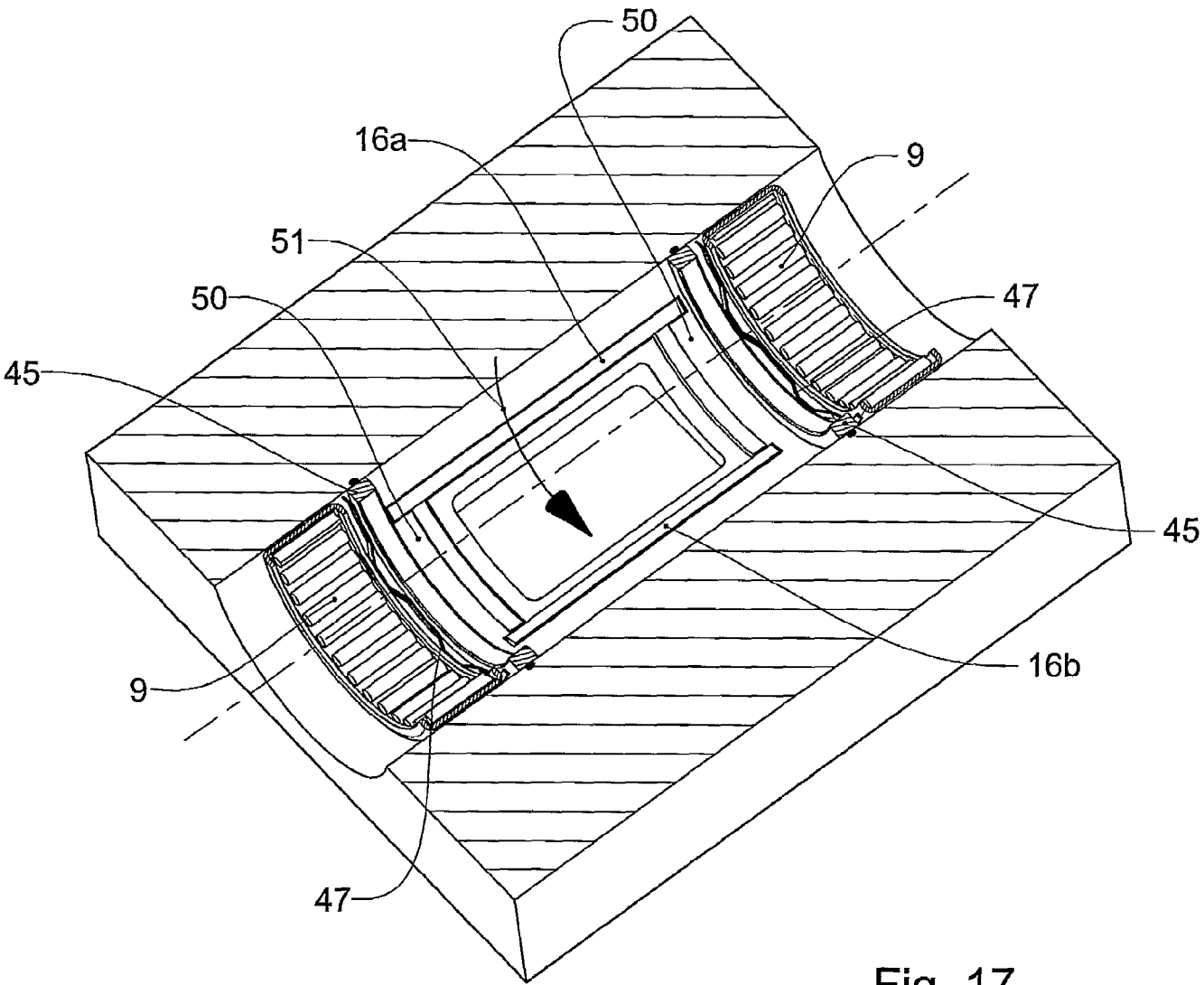
FIG. 17 shows a section through a seventh embodiment of a rotary valve assembly in accordance with the present invention.

The seventh embodiment of the present invention shown in FIG. 17 addresses this issue. The rotary valve assembly shown in FIG. 17 is the same as the sixth embodiment of the invention shown in FIGS. 14, 15 and 16 except that axial seals 16*a* and 16*b* have different lengths.

Arrow 51 indicates the direction that valve 1 (not shown in this view) rotates. Axial seal 16*a* is defined as a 'leading' axial seal in that inlet opening 7 and exhaust opening 8 must pass this seal first as they open into window 15. Similarly, axial seal 16*b* is defined as a 'trailing' axial seal. In this embodiment, leading axial seal 16*a* is longer than trailing axial seal 16*b*. The axial gaps between the ends of leading axial seal 16*a* and valve sealing rings 45 is minimal. Therefore, gas that vents from leak cavities 50 largely only flows through the axial gaps between the ends of trailing axial seal 16*b* and valve sealing rings 45. During the compression and combustion strokes, the blow-by that vents from the ends of trailing axial seal 16*b* vents directly to inlet opening 7 which is adjacent to trailing axial seals 16*b*.

Figure 18:
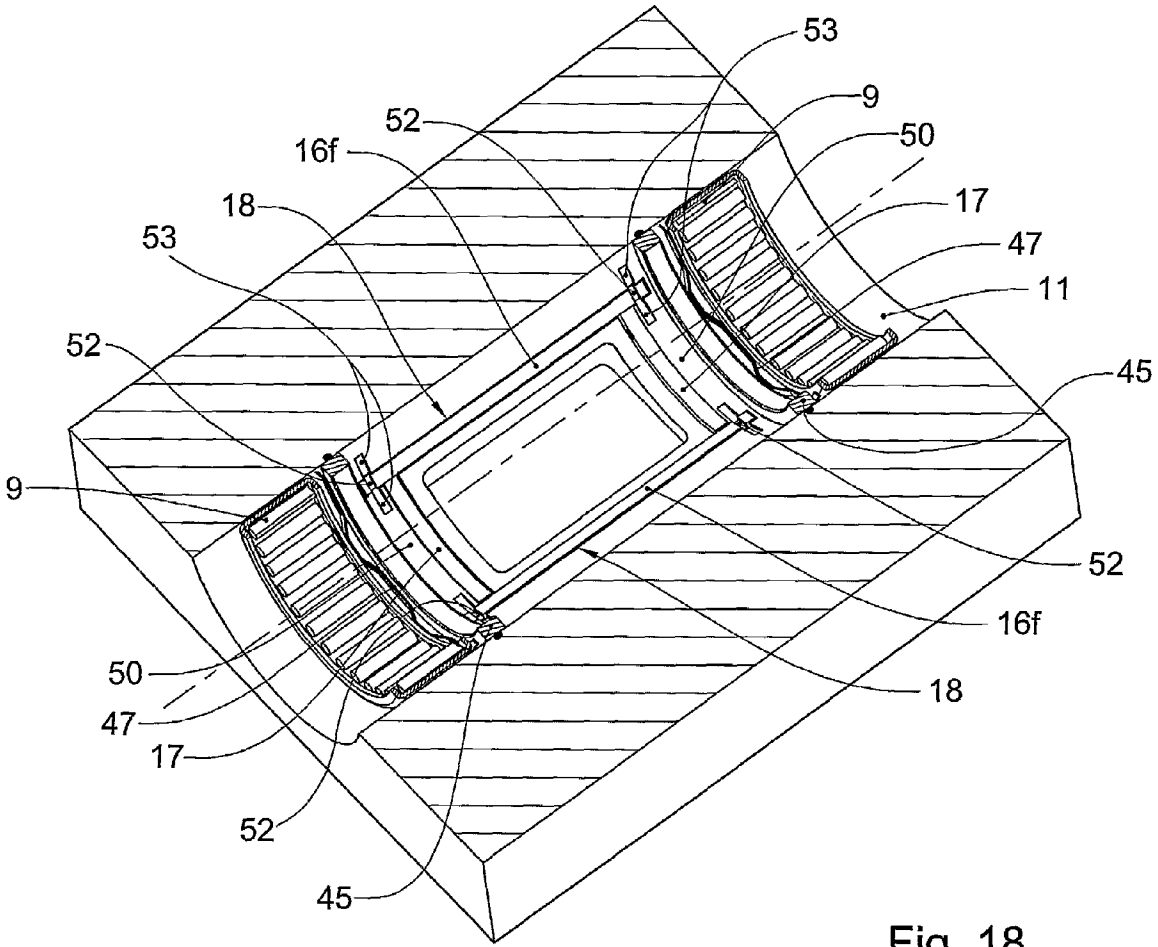
FIG. 18 shows a section through an eighth embodiment of a rotary valve assembly in accordance with the present invention.

FIG. 18 shows a section through an eighth embodiment of a rotary valve assembly in accordance with the present invention. The rotary valve assembly shown in FIG. 18 is the same as the as the sixth embodiment of the invention shown in FIGS. 14, 15 and 16 except with an alternative venting path for situations where the overall length of the rotary valve assembly must be kept to a minimum. To achieve minimum overall length, the axial gaps between the ends of axial seals 16*f* and valve sealing rings 45 are kept to a minimum and therefore an alternative path is required to vent leak cavities 50. The sealing faces near the ends of axial seals 16*f* are radially relieved by relief steps 52, axially outside of circumferential seals 17. Bore 11 is also radially relieved in the area immediately adjacent to each step 52 by means of relief grooves 53, axially aligned with steps 52. Relief grooves 53 are substantially arcuate for ease of manufacture and relieve both sides of axial slots 18. The combination of relief steps 52 and relief grooves 53 provide a passage to vent leak cavities 50. Either both leading and trailing axial seals may be relieved or only the trailing axial seal may be relieved depending on the application. Relieving only the trailing axial seal gives the advantage of discharge to inlet opening 7 only, as described with respect to the seventh embodiment.

Figure 19:
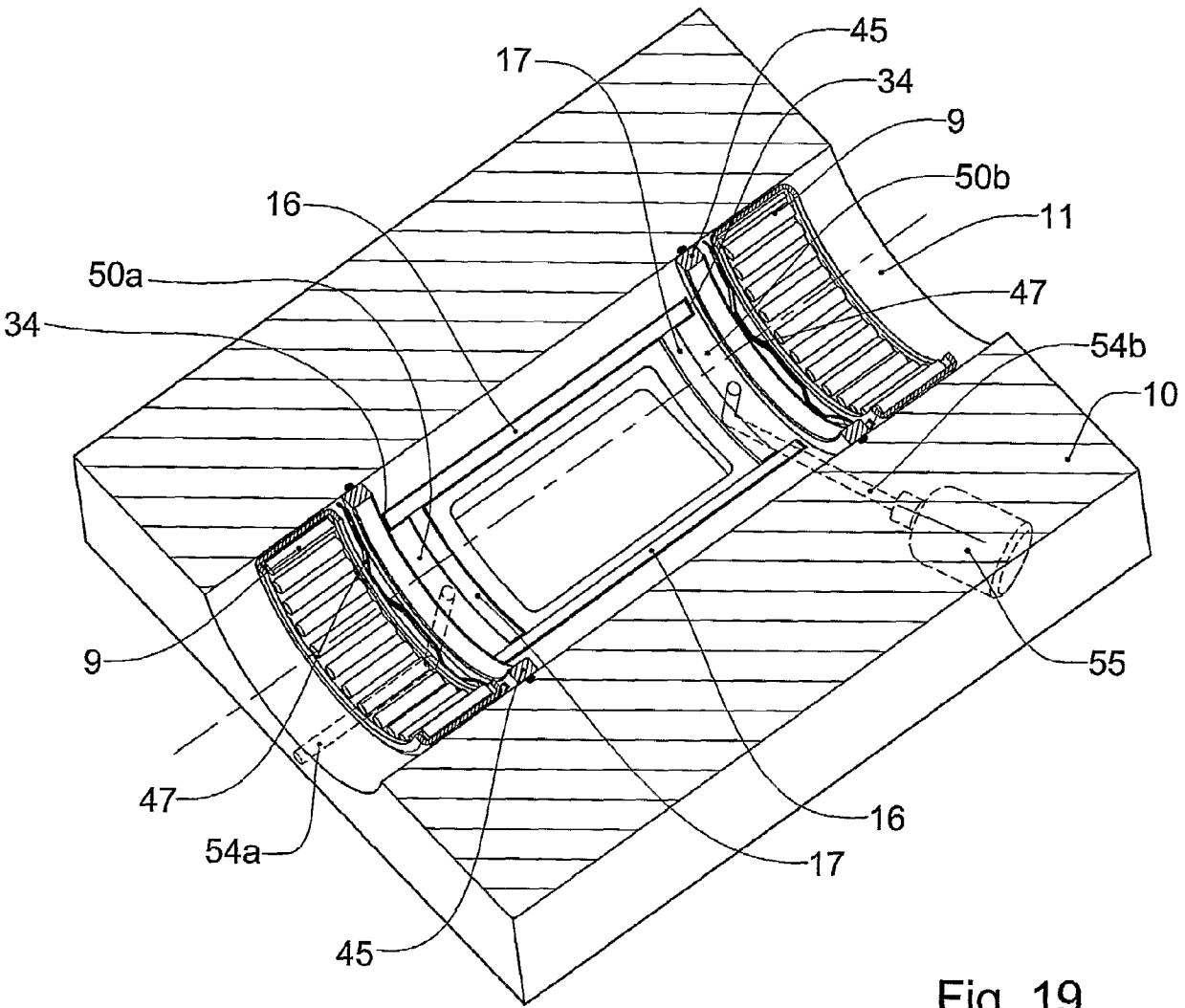
FIG. 19 shows a section through a ninth embodiment of a rotary valve assembly in accordance with the present invention.

FIG. 19 shows a section through a ninth embodiment of a rotary valve assembly in accordance with the present invention. The rotary valve assembly shown in FIG. 19 is the same as the sixth embodiment of the invention shown in FIGS. 14, 15 and 16 except with two different alternative venting methods. In this embodiment, the axial gaps between the ends of axial seals 16 and seal rings 45 is kept to a minimum to substantially prevent leak cavities 50*a* and 50*b* from venting through these gaps. In the first method, vent hole 54*a* in bore 11 vents leak cavity 50*a*. Vent hole 54*a* is connected by piping not shown to the inlet manifold of the engine. Therefore leak cavity 50*a* communicates with inlet port 2 and any blow-by gas in leak cavity 50*a* is recycled back into the cylinder. In the second method, vent hole 54*b* in bore 11 vents leak cavity 50*b*. Vent hole 54*b* is connected to reservoir 55 with an appropriate volume. Reservoir 55 may be built into cylinder head 10 or external. Reservoir 55 acts as a capacitor preventing the build up of excessive pressure in leak cavity 50*b* that would otherwise unseat valve sealing ring 45. During the compression and combustion strokes, blow-by gases charge reservoir 55, and then during the following inlet stroke, reservoir 55 discharges back to the cylinder through vent cavity 50*b* and the seal array. Reservoir 55 also discharges to a lesser extent through the remaining small axial gaps between the end 34 of axial seals 16 and valve sealing rings 45, throughout the cycle. Either first or second method may be used to vent one or both ends of the seal array.

Figure 20:
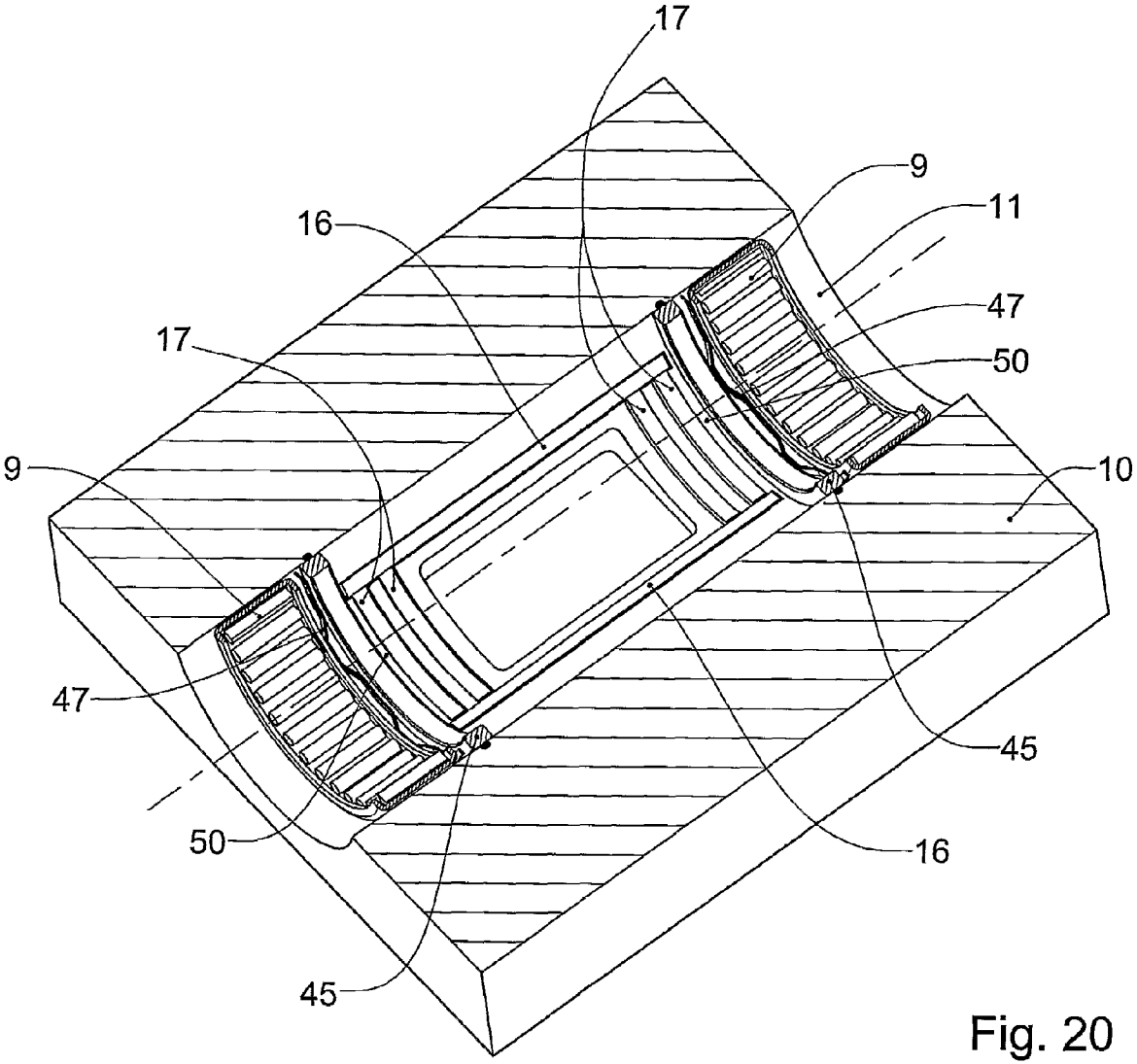
FIG. 20 shows a section through a tenth embodiment of a rotary valve assembly in accordance with the present invention.

FIG. 20 shows a section through a tenth embodiment of a rotary valve assembly in accordance with the present invention. The rotary valve assembly shown in FIG. 20 is the same as the as the sixth embodiment of the invention shown in FIGS. 14, 15 and 16 except with two circumferential seals at each end of the seal array in the same manner as the fifth embodiment of the invention shown in FIG. 13. The additional circumferential seals 17 improve the level of sealing in certain applications of the present invention, in a similar manner to that of a second compression ring in a piston. In this arrangement the volume of blow-by gases reaching leak cavities 50 is much reduced and is dealt with in the same manner as described above.

The present invention has three important elements. The first of which is the geometry of the seal array and the individual sealing elements. Placing the circumferential seals 17 axially inboard of the ends of the axial seals 16 addresses several problems of the sealing systems disclosed in U.S. Pat. No. 4,036,184 (Guenther) and U.S. Pat. No. 4,852,532 (Bishop), as follows:

Firstly, the small radial section of the circumferential seals 17 dramatically reduces the crevice volume around these seals compared to the sealing system disclosed in U.S. Pat. No. 4,036,184 (Guenther) and allows an excellent seal to be made against the outside of cylindrical portion 4. The small circumferential length of the circumferential seals 17 dramatically reduces the crevice volume around these seals compared to the sealing system disclosed in U.S. Pat. No. 4,852,532 (Bishop). The location of the circumferential seals 17 immediately adjacent the ends of the window 15 substantially reduces the crevice volume between the window 15 and the circumferential seals 17.

Secondly, by placing the circumferential seals 17 between the axial seals 16, the leakage is discharged into a leakage cavity 50 where in combination with an additional second circumferential sealing ring 17 or a valve sealing ring 45 it is trapped and can be managed to prevent most of the leakage reaching the exhaust port 3, where it would be discharged as HC emissions.

Thirdly, the placement of the circumferential seals 17 between a pair of inwardly inclined axial seals 16 allows the seal pack to be self locking, thus greatly simplifying the assembly process.

Finally, the seal array is housed in a combination of slots 18,19 that can be produced in mass production. This is clearly not the case with U.S. Pat. No. 4,036,184 (Guenther).

The seal geometry of the present invention overcomes the problems of the sealing system disclosed in U.S. Pat. No. 5,526,780 (Wallis) of excessive crevice volume, high valve friction, increased valve diameter and very difficult assembly.

The second important element of the present invention is the additional sealing details designed to overcome the leakage problems of U.S. Pat. No. 4,036,184 (Guenther) and U.S. Pat. No. 4,852,532 (Bishop). By placing springs 21 under the axial seals 16 to block the flow of gas between the axial seal underside 5 and the axial seal slot root 6 the major leakage path (leakage types D to E to A) is eliminated. By controlling the side clearance of the axial seals 16 in their slots 18 axially outside the circumferential seals 17 leakage from the other major leakage path (leakage types F to B) is controlled. The net effect is a substantial reduction in TELA. Depending on the details of the various arrangements the TELA of this invention could be less than one twentieth (1/20) of the prior art arrangements of U.S. Pat. No. 4,036,184 (Guenther) and U.S. Pat. No. 4,852,532 (Bishop).

The third important feature of the present invention is the introduction of an oil sealing system that acts in combination with the gas sealing elements to control the movement of the leakage gases and to prevent the ingress of oil to cylindrical portion 4.

The term "comprising" as used herein is used in the inclusive sense of "including" or "having" and not in the exclusive sense of "consisting only of".

The invention claimed is:

1. A rotary valve assembly for an internal combustion engine comprising an axial flow rotary valve having a cylindrical portion, and an inlet port and an exhaust port terminating as openings in said cylindrical portion, a cylinder head having a bore in which said valve rotates about an axis with a predetermined small clearance between said cylindrical portion and said bore, a window in said bore communicating with a combustion chamber, said window being substantially rectangular in shape and said openings periodically communicating with said window as said valve rotates, bearing means journaling said valve in said bore, an array of floating seals surrounding said window, and a bias means preloading said array of floating seals against said cylindrical portion, said array of floating seals comprising at least two spaced apart elongate axial seals adjacent opposite sides of said window and at least two spaced apart arcuate circumferential seals adjacent opposite ends of said window, each said axial seal being housed in a respective axially extending axial slot formed in said bore, and each said circumferential seal being housed in a respective circumferentially extending circumferential slot formed in said bore, characterised in that said circumferential seals are axially disposed between the ends of said axial seals.

2. A rotary valve assembly as claimed in claim 1 wherein said circumferential seals extend with small clearance between the circumferentially inner faces of said axial seals.

3. A rotary valve assembly as claimed in claim 1 wherein said axial slots are deeper than said circumferential slots.

4. A rotary valve assembly as claimed in claim 1 wherein said bias means comprises at least one spring disposed at an end of at least one said axial seal, said spring being substantially the same circumferential width as said axial seal and spanning between the underside of said axial seal and the root of its respective said axial slot, said spring blocking combustion gases from flowing between the underside of said axial seal and the root of its respective said axial slot past said end of said axial seal.

5. A rotary valve assembly as claimed in claim 4 wherein said spring comprises a closed end substantially axially aligned with said end of said axial seal and first and second legs extending axially from said closed end towards the middle of said axial seal, said first leg being in contact with the underside of said axial seal, and said second leg being in contact with the root of its respective said axial slot.

6. A rotary valve assembly as claimed in claim 5 wherein said first leg is shorter than said second leg.

7. A rotary valve assembly as claimed in claim 4 wherein said spring is formed integrally with said axial seal.

8. A rotary valve assembly as claimed in claim 1 wherein there is a minimum side clearance between each said axial seal and its respective axial slot in the regions axially outside said circumferential slots.

9. A rotary valve assembly as claimed in claim 1 wherein said axial seals are inclined towards said axis.

10. A rotary valve assembly as claimed in claim 1 wherein said axial slots are blind ended and there is minimal clearance between the ends of each said axial seal and the ends of its respective axial slot.

11. A rotary valve assembly as claimed in claim 10 wherein the clearance between at least one end of at least one said axial seal and the adjacent end of its respective axial slot is spanned by a flexible member blocking the flow of combustion gases through said clearance.

12. A rotary valve assembly as claimed in claim 1 wherein at least one end of at least one said axial seal has a recess formed in its underside, a flexible sealing element being disposed in said recess, spanning between the sides of its respective said axial slot.

13. A rotary valve assembly as claimed in claim 1 wherein at least one said circumferential slot extends circumferentially past the circumferentially outermost side of at least one said axial slot and the said axial seal housed in said axial slot covers the intersection of the root of said circumferential slot with the circumferentially outermost side of said axial slot.

14. A rotary valve assembly as claimed in claim 1 wherein said bore has at least one radial step disposed at an end of said axial slots, the depth of said radial step being at least equal to the depth of said axial slots, said end of said axial slots being blind-ended by a sleeve abutting said radial step.

15. A rotary valve assembly as claimed in claim 1 wherein there are two said circumferential seals at each end of said window.

16. A rotary valve assembly as claimed in claim 1 wherein said valve has first and second valve seats extending radially inwards from opposite ends of said cylindrical portion, said cylindrical portion extending axially a small distance past the ends of said axial seals, said rotary valve assembly further comprising first and second sealing rings flexibly sealed to said bore and biased axially inwards against said first and second valve seats respectively.

17. A rotary valve assembly as claimed in claim 16 wherein said at least two axial seals comprise a leading axial seal and a trailing axial seal, said trailing axial seal being shorter than said leading axial seal.

18. A rotary valve assembly as claimed in claim 16 wherein said bore has at least one vent hole located axially outside said circumferential seals, axially inside said sealing rings, and circumferentially between said axial seals.

19. A rotary valve assembly as claimed in claim 18 wherein said vent hole communicates with a reservoir.

20. A rotary valve assembly as claimed in claim 18 wherein said vent hole communicates with said inlet port.

21. A rotary valve assembly as claimed in claim 16 wherein a portion of the sealing face of at least one end of at least one said axial seal, axially outside said circumferential seals, and the area of said bore immediately adjacent to said end are both radially relieved.

22. A rotary valve assembly as claimed in claim 16 wherein said valve sealing rings are flexibly sealed by o-rings disposed between said valve sealing rings and said bore.

* * * * *